US005124804A

United States Patent [19]

Socarras

[11] Patent Number: 5,124,804

[45] Date of Patent: Jun. 23, 1992

[54] PROGRAMMABLE RESOLUTION VIDEO CONTROLLER

[75] Inventor: Angel E. Socarras, Lake Mary, Fla.

[73] Assignee: NCR Corporation, Dayton, Ohio

[21] Appl. No.: 580,441

[22] Filed: Sep. 10, 1990

[51] Int. Cl.[5] ..... H04N 5/04

[52] U.S. Cl. ..... 358/150; 358/148; 358/903

[58] Field of Search ..... 358/150, 148, 151, 152, 358/903; 340/814

[56] References Cited

U.S. PATENT DOCUMENTS

| | | | |
|---|---|---|---|
| 4,316,219 | 2/1982 | Smith et al. | 358/150 |
| 4,328,513 | 5/1982 | Furihato et al. | 358/150 |
| 4,412,250 | 10/1983 | Smith | 358/150 |
| 4,417,275 | 11/1983 | Harshbarger et al. | 358/139 |
| 4,466,014 | 8/1984 | Wilensky et al. | 358/139 |
| 4,616,260 | 10/1986 | Erwin et al. | 358/150 |
| 4,670,782 | 6/1987 | Harshbarger et al. | 358/151 |
| 4,812,828 | 3/1989 | Nishi et al. | 340/706 |
| 4,816,913 | 3/1989 | Harney et al. | 358/133 |
| 4,819,190 | 4/1989 | Hinman et al. | 364/521 |
| 4,843,471 | 6/1989 | Yazawa et al. | 358/148 |
| 4,872,054 | 10/1989 | Gray et al. | 358/148 X |
| 4,891,705 | 1/1990 | Suzuki et al. | 358/148 |
| 4,905,167 | 2/1990 | Yamaoka et al. | 358/903 |
| 4,958,227 | 9/1990 | Wan | 358/148 |
| 4,964,069 | 10/1990 | Ely | 358/148 X |

*Primary Examiner*—Victor R. Kostak
*Attorney, Agent, or Firm*—James M. Stover

[57] ABSTRACT

A video controller which can be programmed to generate horizontal and vertical blanking and synchronization signals for driving video monitors having different resolutions or operating frequencies includes storage registers for receiving and storing pixel count information associated with the beginning of horizontal blanking, the beginning of horizontal synchronization, the end of horizontal blanking, the end of horizontal synchronization and line count information associated with the beginning of vertical blanking, the beginning of vertical synchronization, and the end of vertical synchronization. The controller further includes circuitry for counting pixels as they are provided by the controller to the monitor and circuitry for counting horizontal scan lines. Properly timed blanking and synchronization signals are generated by comparing pixel count and line count information to the stored pixel and line count values.

3 Claims, 30 Drawing Sheets

| | | |
|---|---|---|
| FIG. 1A | FIG. 1B | FIG. 1C |
| FIG. 1D | FIG. 1E | FIG. 1F |

HSTLDB
HFPLDB
HSTLDB
HBPLDB
CUPOSLDB
HSTRDB
HFPRDB
HSWRDB
HBPRDB
CUPOSRDB
HCNTRDB
CUR CNTRRDB
TSTM
TSTCLK
HORIZONTAL TIMING LOGIC
SESEL0
BNKSEL0
BNKSEL1
CSIZE
UTWRB
RO
RAMRDYB
PROCLKB
HPC
SESEL1

| | |
|---|---|
| FIG. 6A | FIG. 6C |
| FIG. 6B | FIG. 6D |

PROGRAMMABLE RESOLUTION VIDEO CONTROLLER

The present invention relates to video display monitors and, more particularly, to a programmable video controller for operating video monitors having different resolutions and timing parameters.

BACKGROUND OF THE INVENTION

The image formed on the screen of most video monitors is produced by scanning an electron beam quickly across the back of the screen in a horizontal direction while also scanning the beam in a vertical direction, but at a slower rate. This process whereby the electron beam is scanned both horizontally and vertically is termed raster scanning. Along the inside surface of the monitor screen is provided a material which emits light when stimulated by the electron beam. To the electron gun which produces the electron scanning beam is provided a video signal comprising a serial stream of data pulses. Each pulse is associated with a different position along a scan line, and, depending upon the amplitude of the pulse, causes the associated screen point, referred to as a picture element or pixel, to emit light. The described raster scanning process is typically repeated at a rate of sixty scans per second.

In addition to the video signal which is provided to the electron beam gun, the logic circuit which drives the monitor must provide vertical and horizontal synchronization signals to control positioning of the scanning beam, and vertical and horizontal blanking signals to "turn off" the electron beam during scan retrace, i.e., while the scanning beam is returned to the beginning of a scan line or the top of the screen.

The scanning process discussed above relates to a monochrome monitor. Color monitors typically employ three light emitting materials on the inside of the monitor screen and scan three electron beams across the screen, the three materials emitting shades of red, blue and green light, respectively.

The resolution of a video screen is defined by the number of scan lines displayed multiplied by the number of pixels on each line. Television sets include monitors which have a resolution of 525×256 pixels. However, the need and desire to improve picture clarity and quality and to increase the amount of information which can be displayed by monitors coupled to personal computers, computer workstations, CAD systems and the like has resulted in the development of video controllers and monitors providing greatly increased image resolutions. For example, the video controller logic board included in the NCR X-Station terminal currently supports a monitor having a resolution of 1280×1024 pixels. However, in order to support other monitors having different resolutions and timing parameters it becomes necessary to alter the video controller logic through hardware changes, possibly designing and constructing a new controller board for each new monitor specification.

OBJECTS OF THE INVENTION

It is therefore an object of the present invention to provide a new and improved video controller.

It is another object of the present invention to provide such a video controller which can be programmed to support video monitors having different resolutions.

It is yet another object of the present invention to provide a new and improved method for generating horizontal and vertical synchronization and blanking signals.

It is still a further object of the present invention to provide such a method which can be used drive video monitors having different resolutions.

SUMMARY OF THE INVENTION

There is provided, in accordance with the present invention, a video controller including means for storing pixel count values associated with the beginning of horizontal blanking, the beginning of horizontal synchronization, the end of horizontal blanking, and the end of horizontal synchronization. The video controller also includes means for storing line count values associated with the beginning of vertical blanking, the beginning of vertical synchronization, and the end of vertical blanking.

The controller generates horizontal blanking and horizontal synchronization signals, properly timed for a particular resolution monitor, by counting pixels and comparing the pixel count to the stored pixel count. In similar fashion, the appropriate vertical blanking and vertical synchronization signals are generated by counting horizontal blanking pulses, which occur once during each horizontal scan, and compares this count with the stored line count values.

The above objects and other objects, features, and advantages of the present invention will become apparent from the following detailed specification when read in conjunction with the accompanying drawings in which applicable reference numerals have been carried forward.

DETAILED DESCRIPTION OF THE PREFERRED EMBODIMENT

Figure 1A:
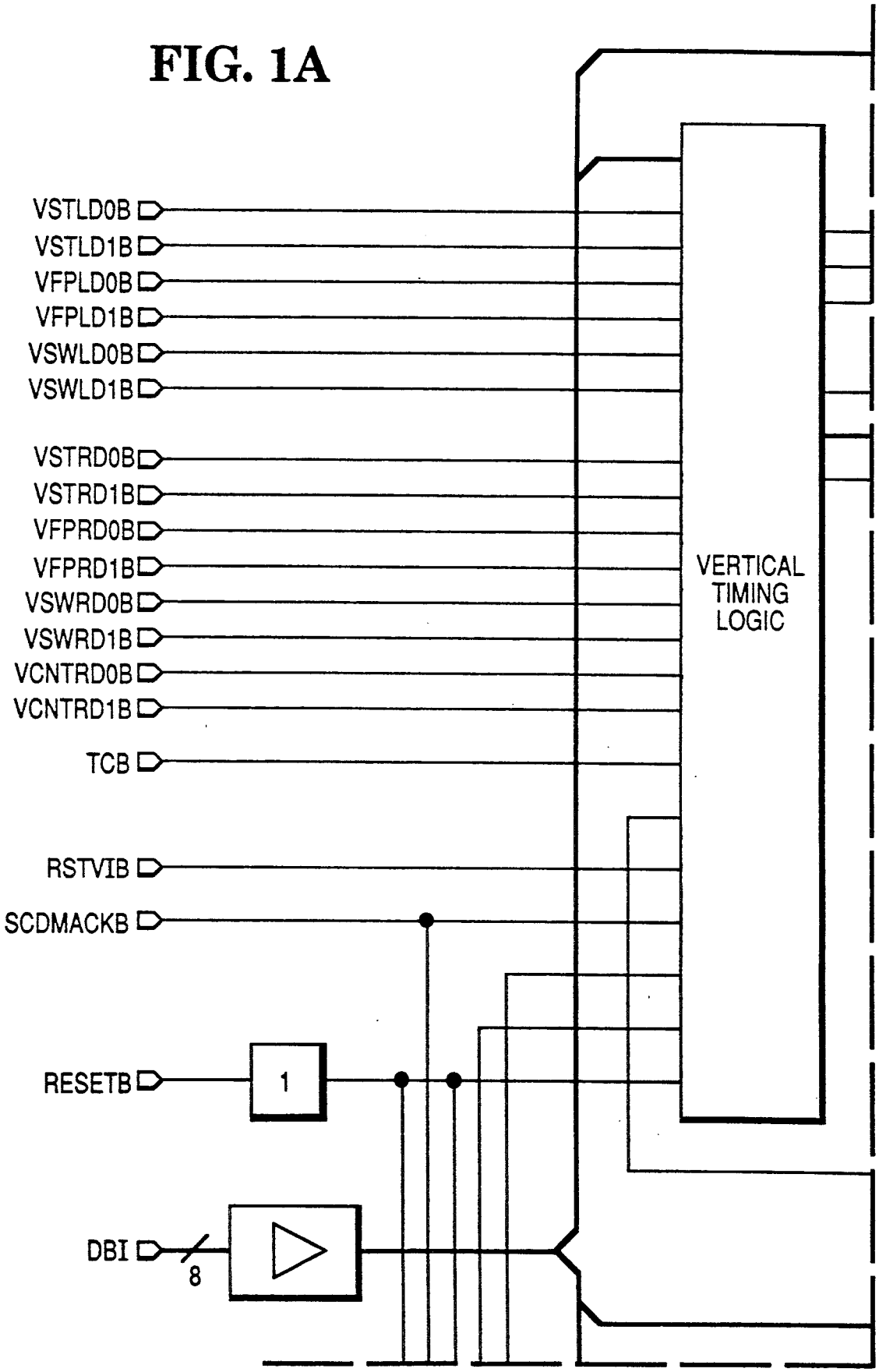
FIGS. 1 and 1A–1F are block schematic diagram of a video controller including circuitry for generating horizontal and vertical blanking and synchronization signals in accordance with the present invention.
Figure 1B:
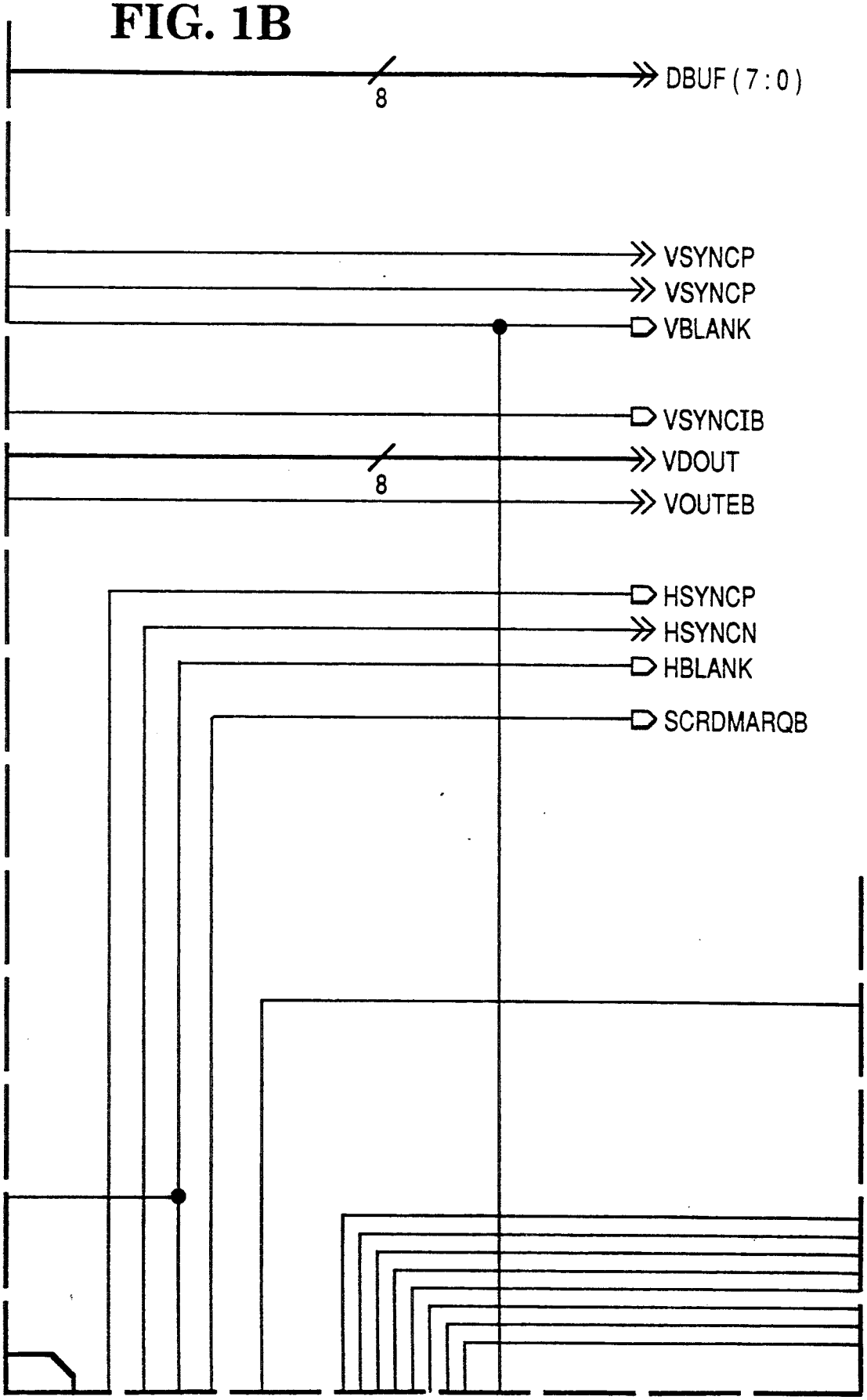
Figures 1, 1C:
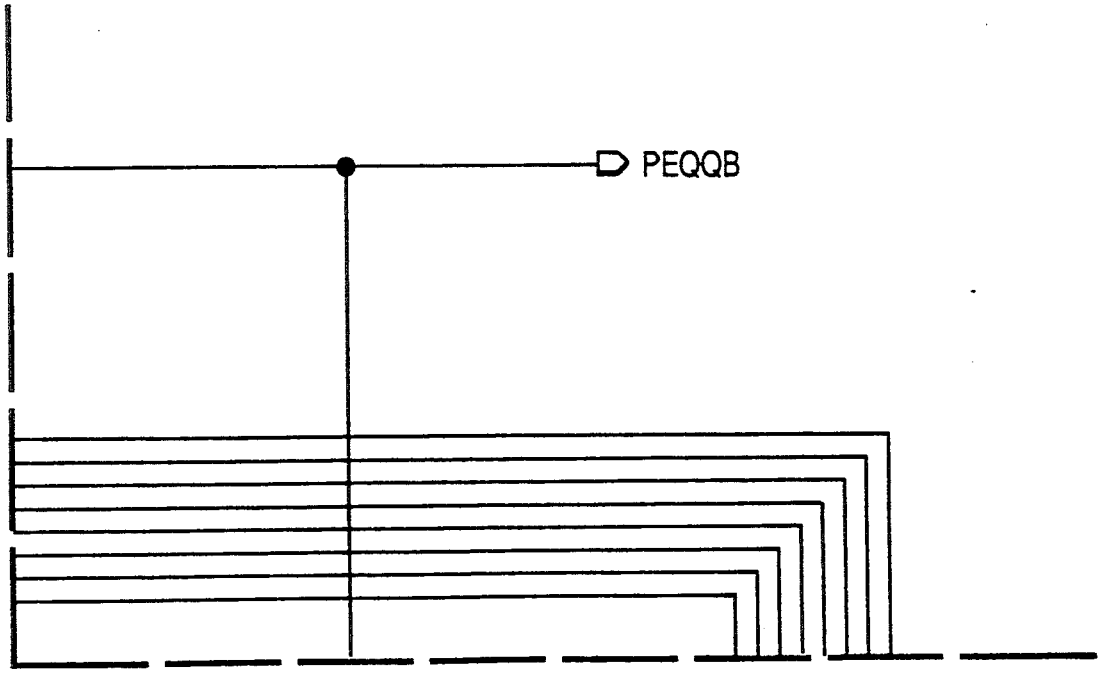
Figure 1D:
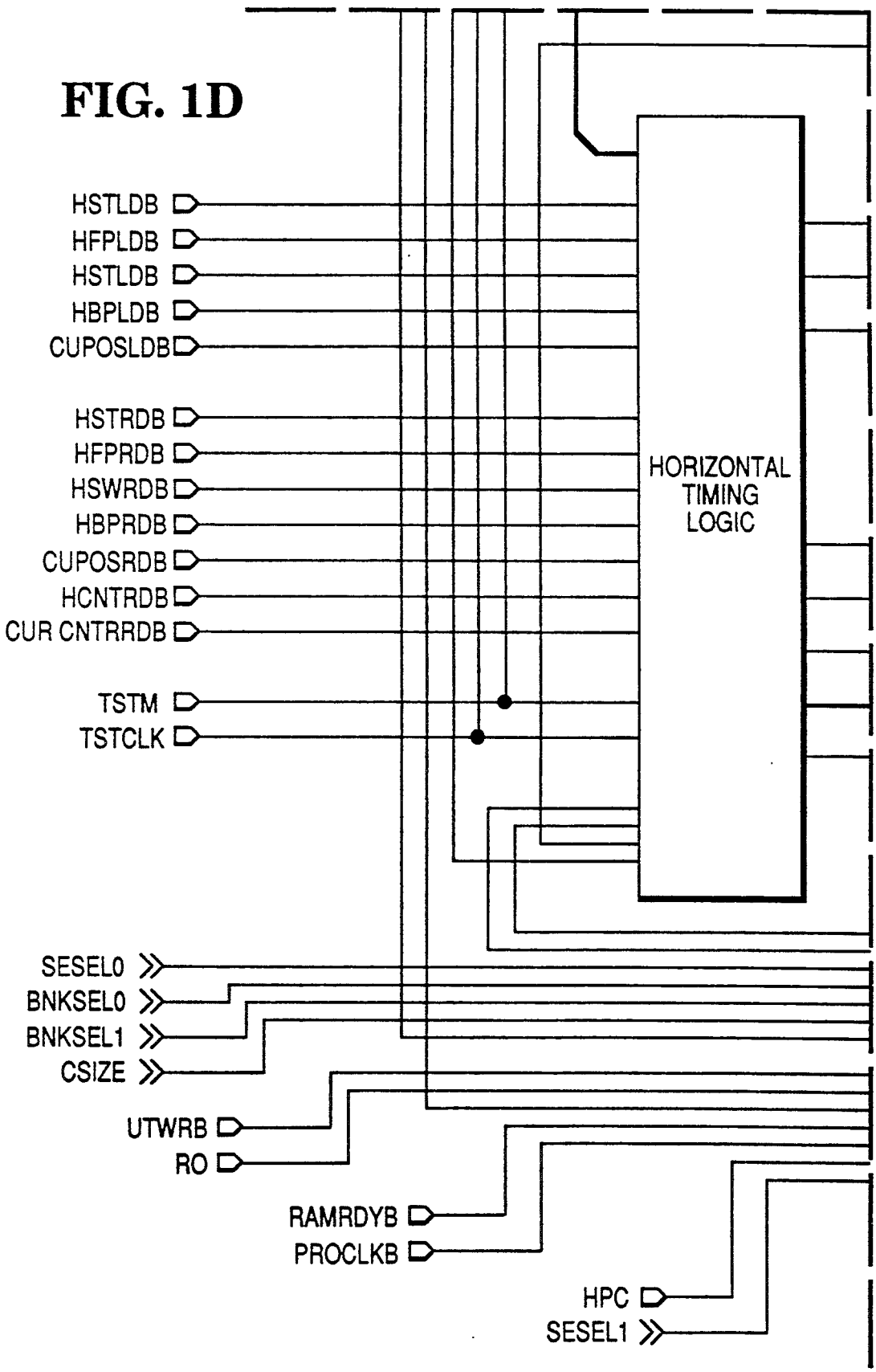
Figure 1E:
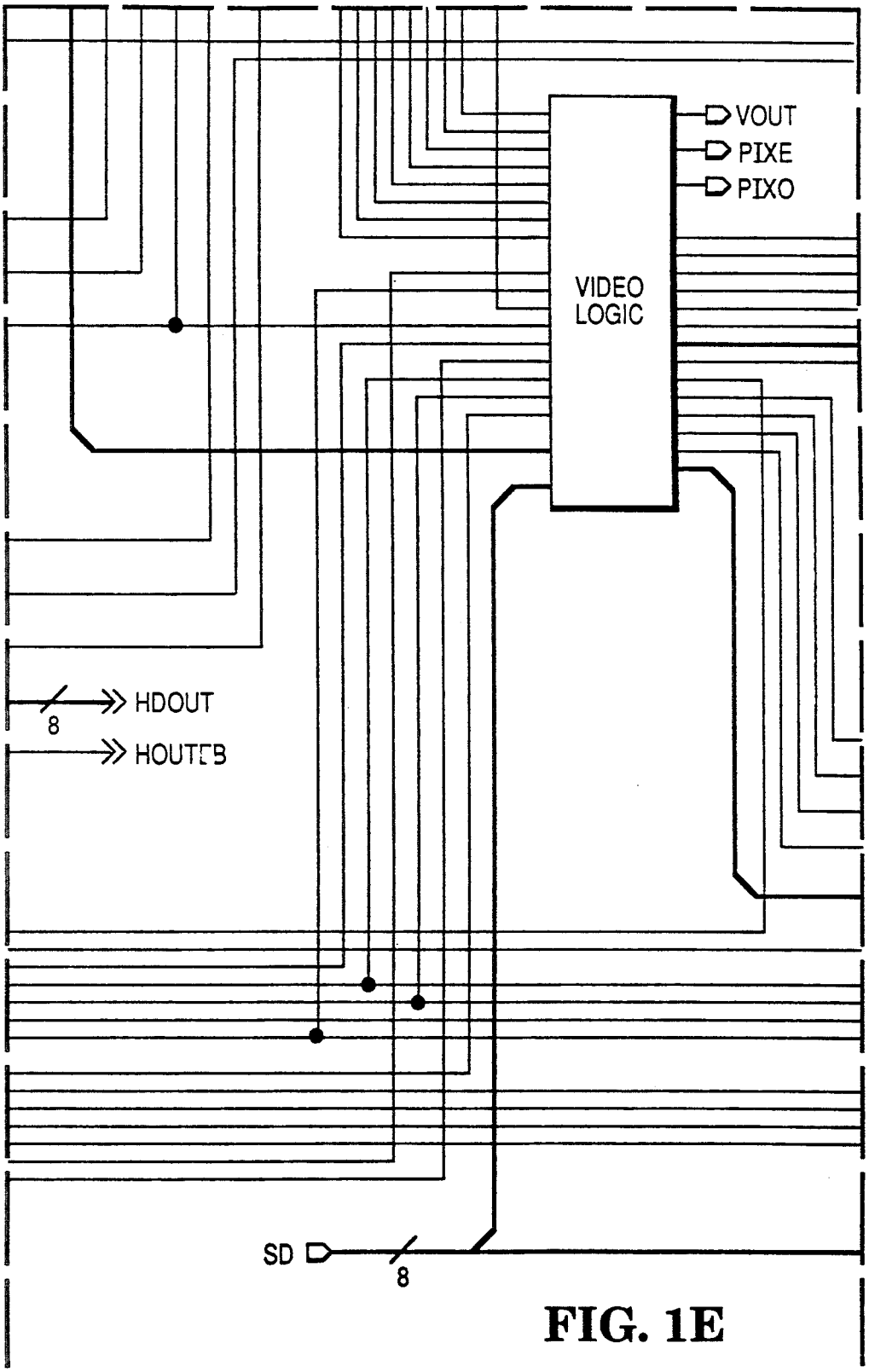
Figure 1F:
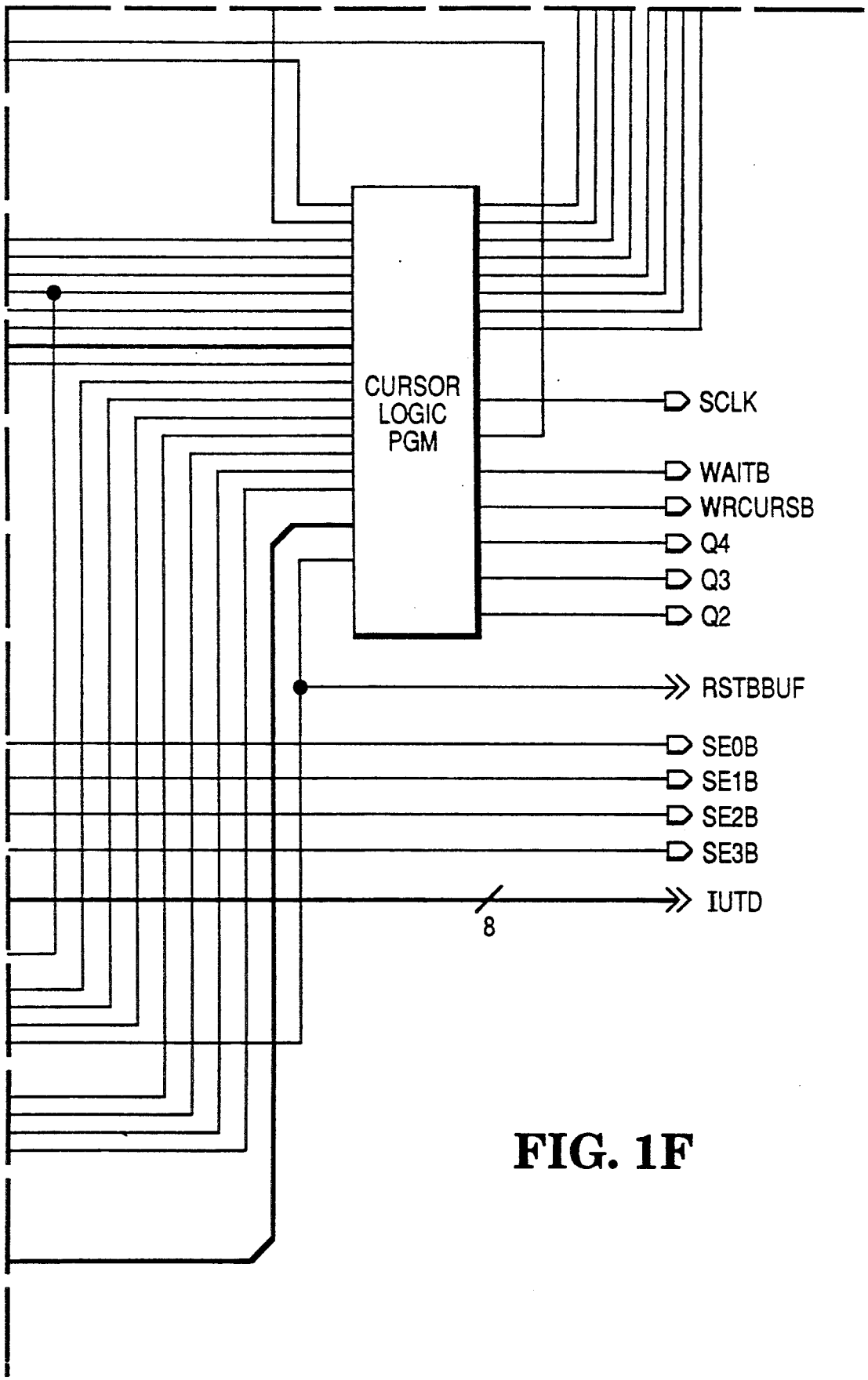
Figure 2:
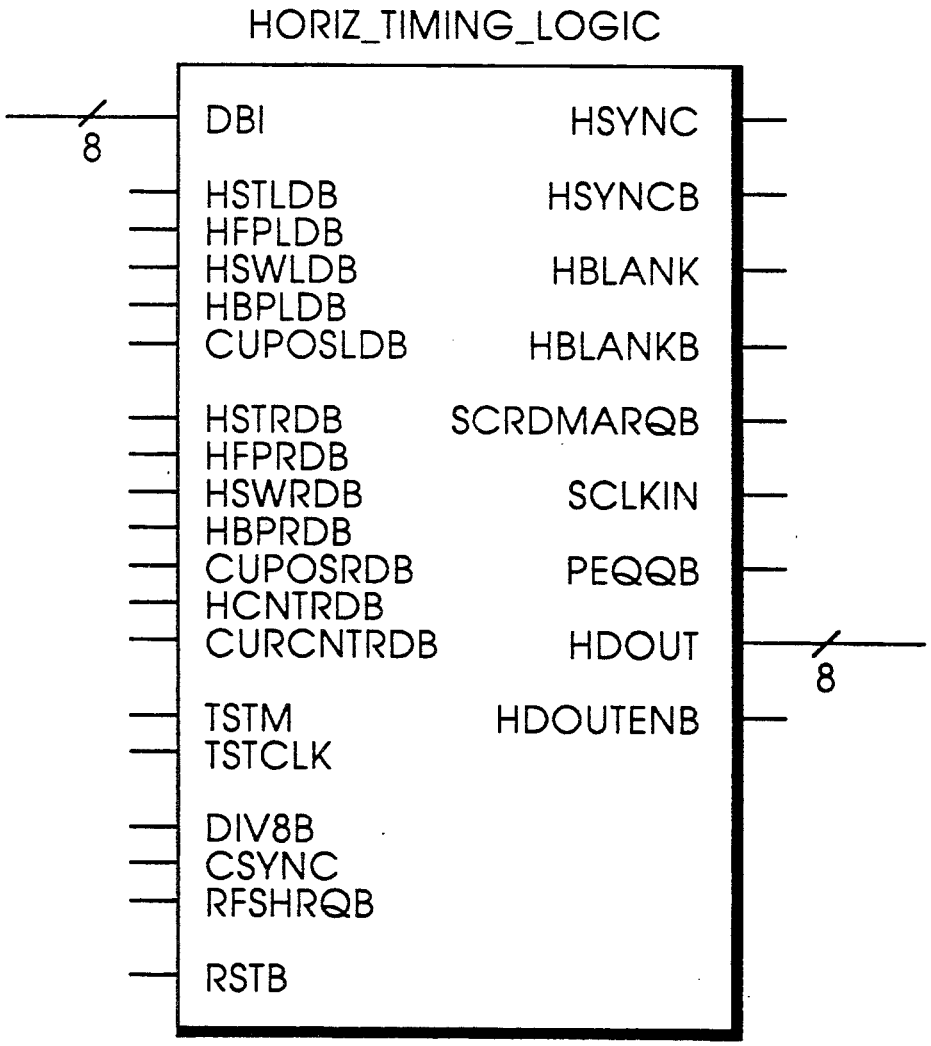
FIG. 2 is a block diagram of the horizontal timing logic block of FIG. 1, showing labeling of the electrical connections to the logic block.
Figure 3:
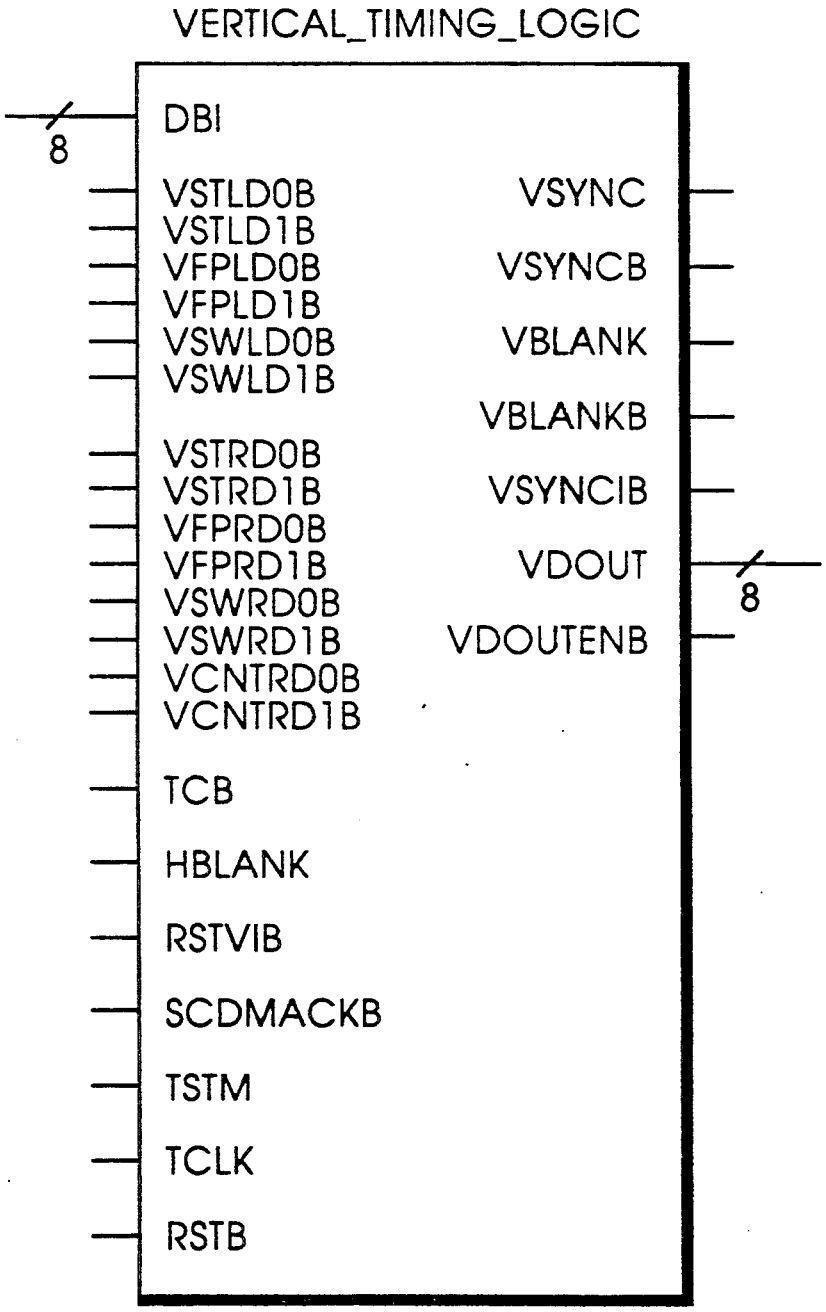
FIG. 3 is a block diagram of the vertical timing logic block of FIG. 1, showing labeling of the electrical connections to the logic block.

Referring now to FIG. 1, there is seen a video controller constructed in accordance with the present invention. The video controller, as shown, implements a high resolution monochrome monitor when used in conjunction with standard off-the-shelf dual port DRAMs. The monitor and DRAMs are not shown. The controller consists of four building blocks: Horizontal Timing Logic 101, Vertical Timing Logic 103, Video Logic 105 and Cursor Logic 107. Horizontal Timing Logic Block 101, shown in FIGS. 1 and 2, generates the horizontal blank and synchronization signals. Similarly, Vertical Timing Logic Block 103, shown in FIGS. 1 and 3, produces the vertical blank and synchronization signals. The horizontal and vertical timing blocks include the structure which permits programming of the controller for operating video monitors having different resolutions and timing parameters. Logic blocks 101 and 103 will be discussed in greater detail below with reference to FIGS. 6 through 19.

Figure 4:
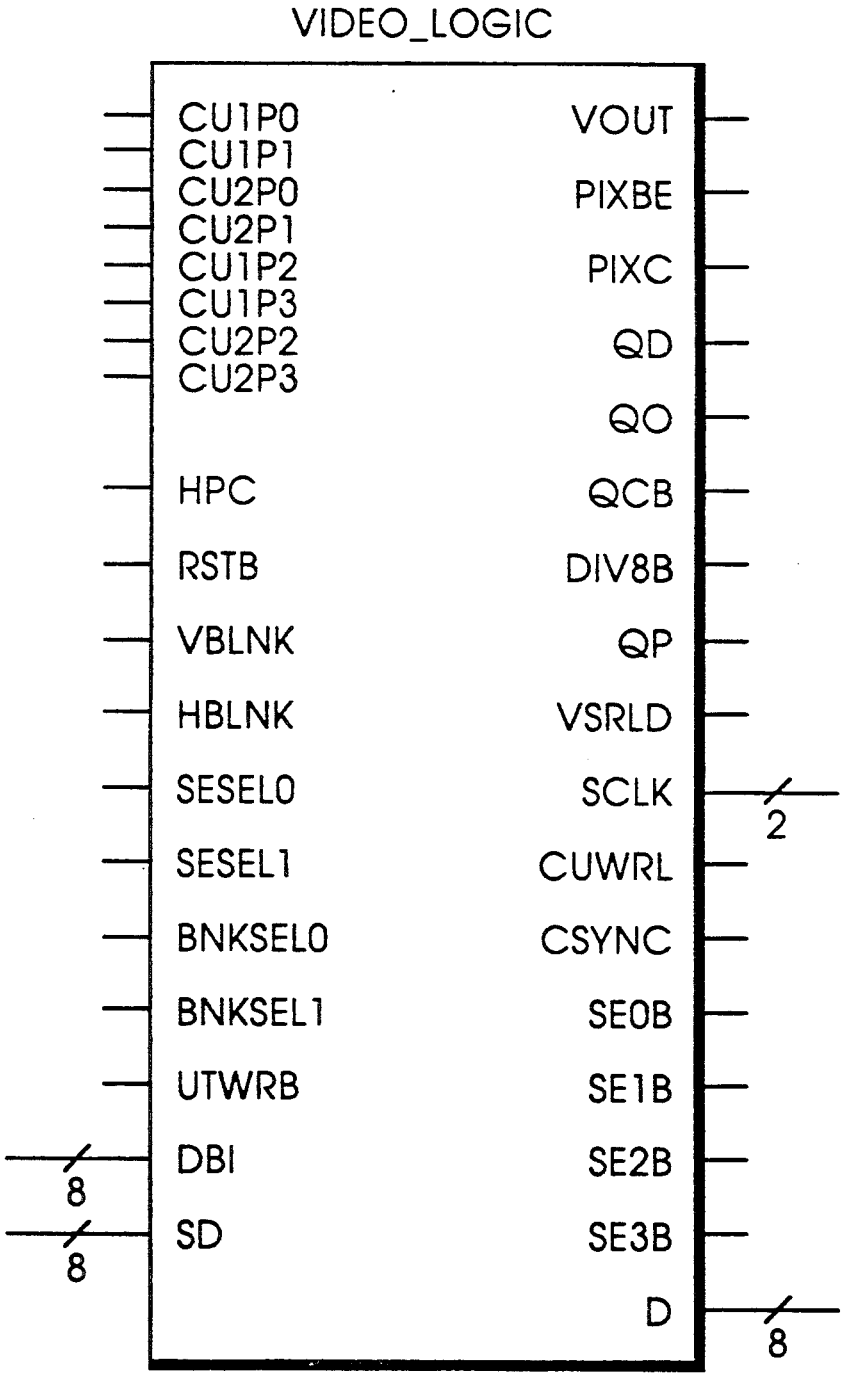
FIG. 4 is a block diagram of the video logic block of FIG. 1, showing labeling of the electrical connections to the logic block.
Figure 5:
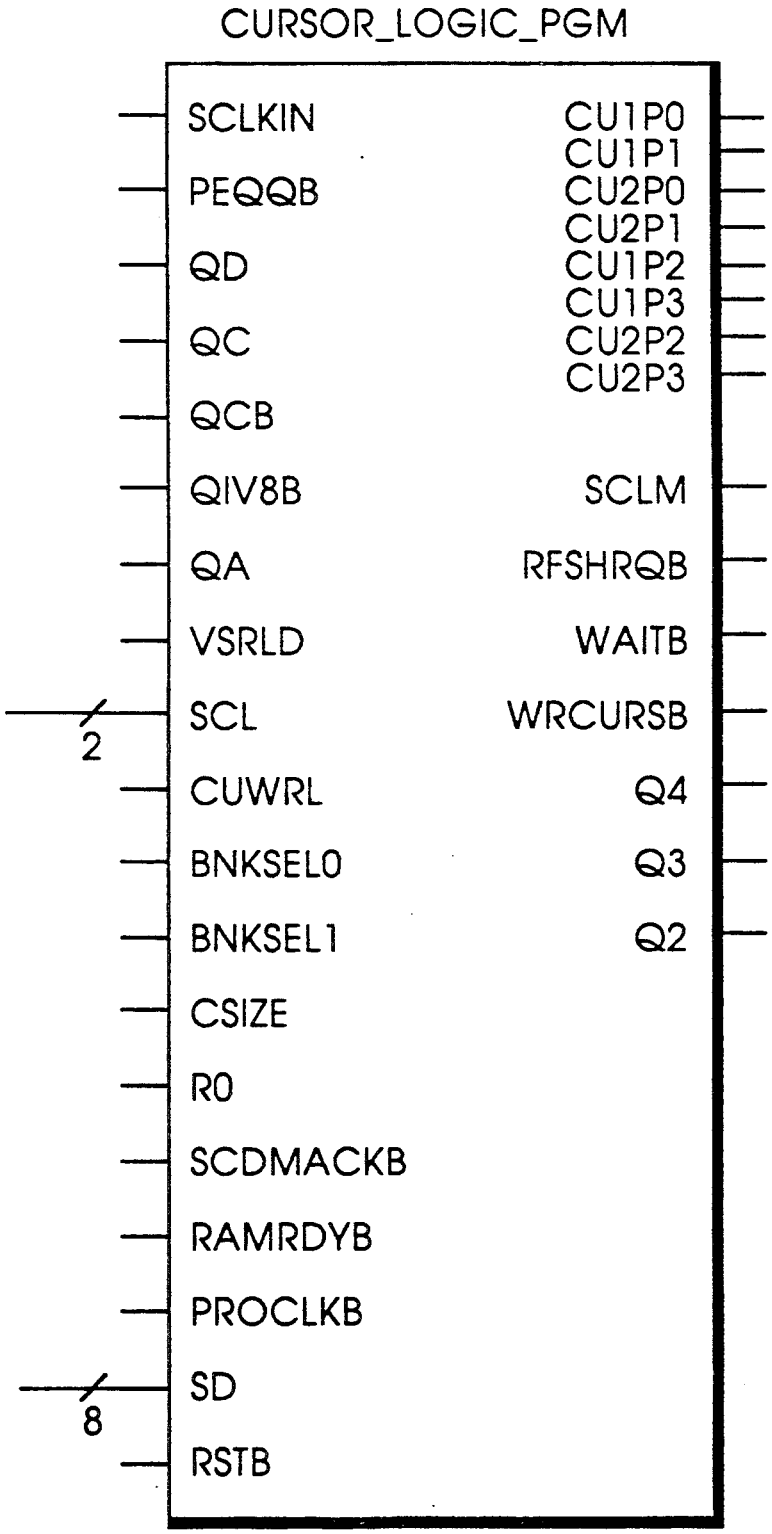
FIG. 5 is a block diagram of the cursor logic logic block of FIG. 1, showing labeling of the electrical connections to the logic block.

Video logic block 105, shown in FIGS. 1 and 4, generates all the signals needed to shift data out of the video DRAMs. The data is loaded from the bus identified by reference letters SD in eight bit packets. The data is then mixed internally with blanking information provided by timing blocks 101 and 103 and cursor information obtained from cursor logic 107 to produce the video output signal VOUT. Cursor logic block 107 takes care of loading, storing and displaying of cursor information.

The function and operation of the video logic and cursor logic blocks should be readily understood by those skilled in the art and will only be discussed herein as necessary to effectuate an understanding of the generation and use of the horizontal and vertical synchronization and blanking signals.

Horizontal Timing Logic

Figure 6A:
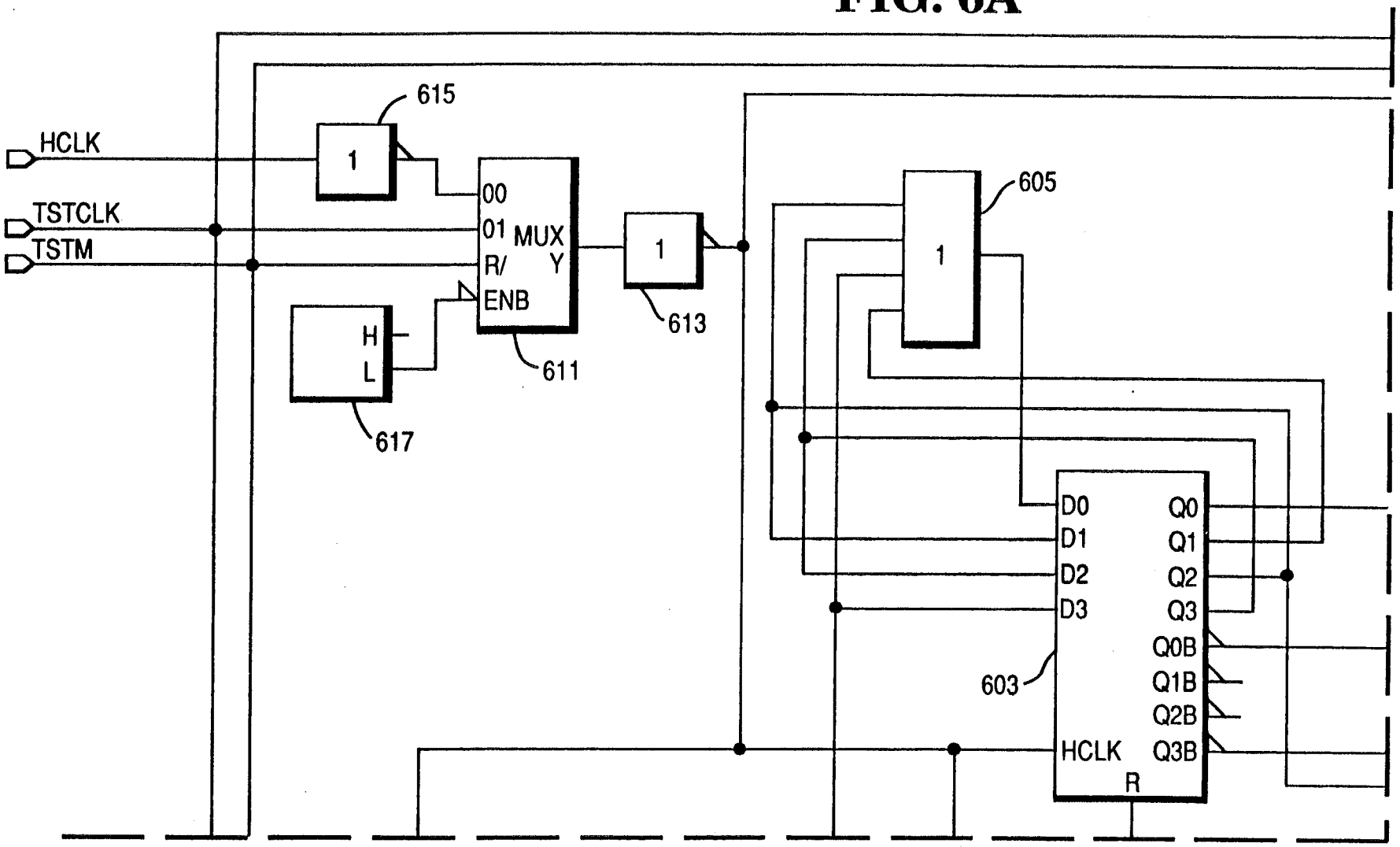
FIGS. 6 and 6A–6D are schematic diagram of the horizontal timing logic block shown in FIGS. 1 and 2.
Figure 6B:
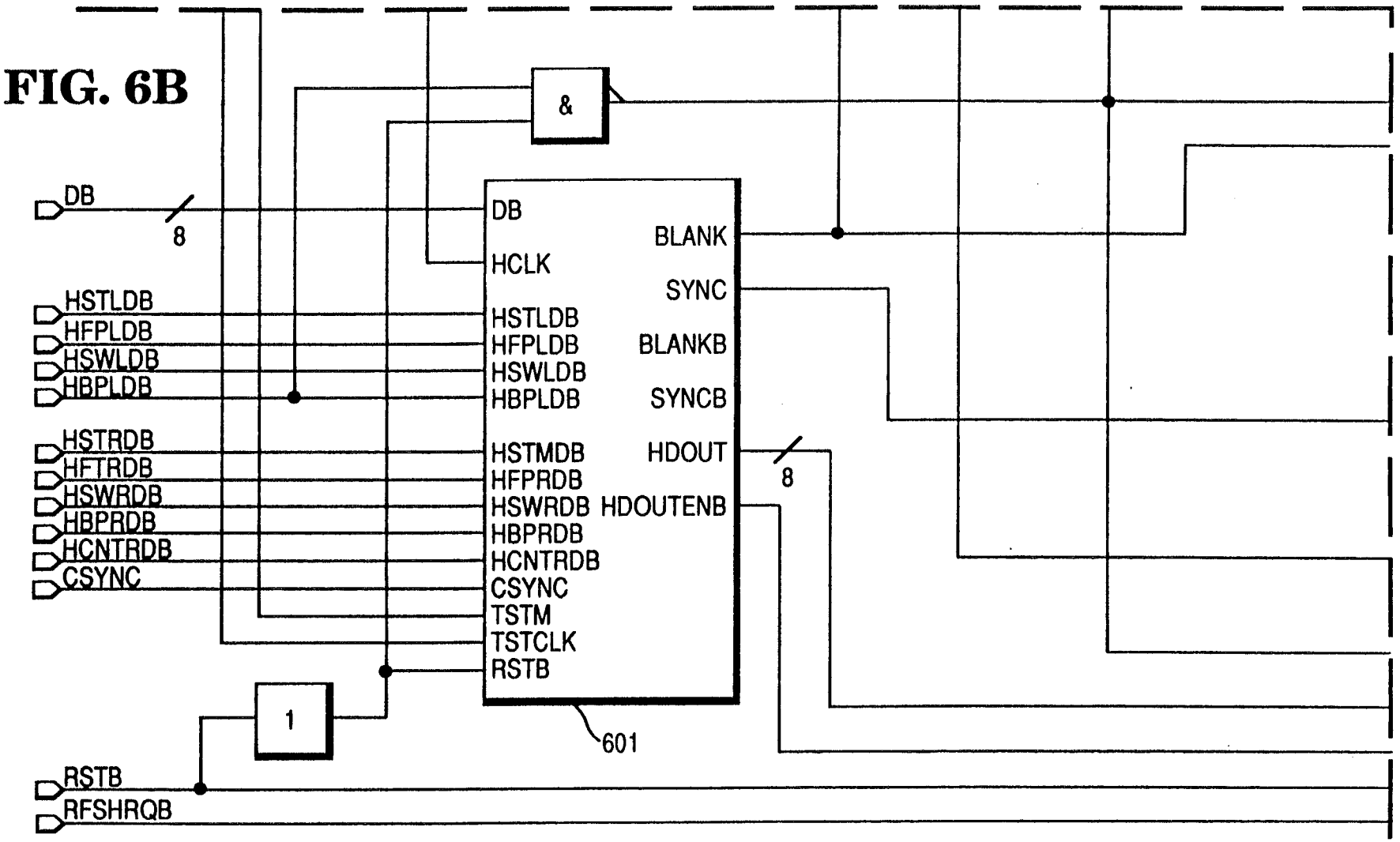
Figure 6C:
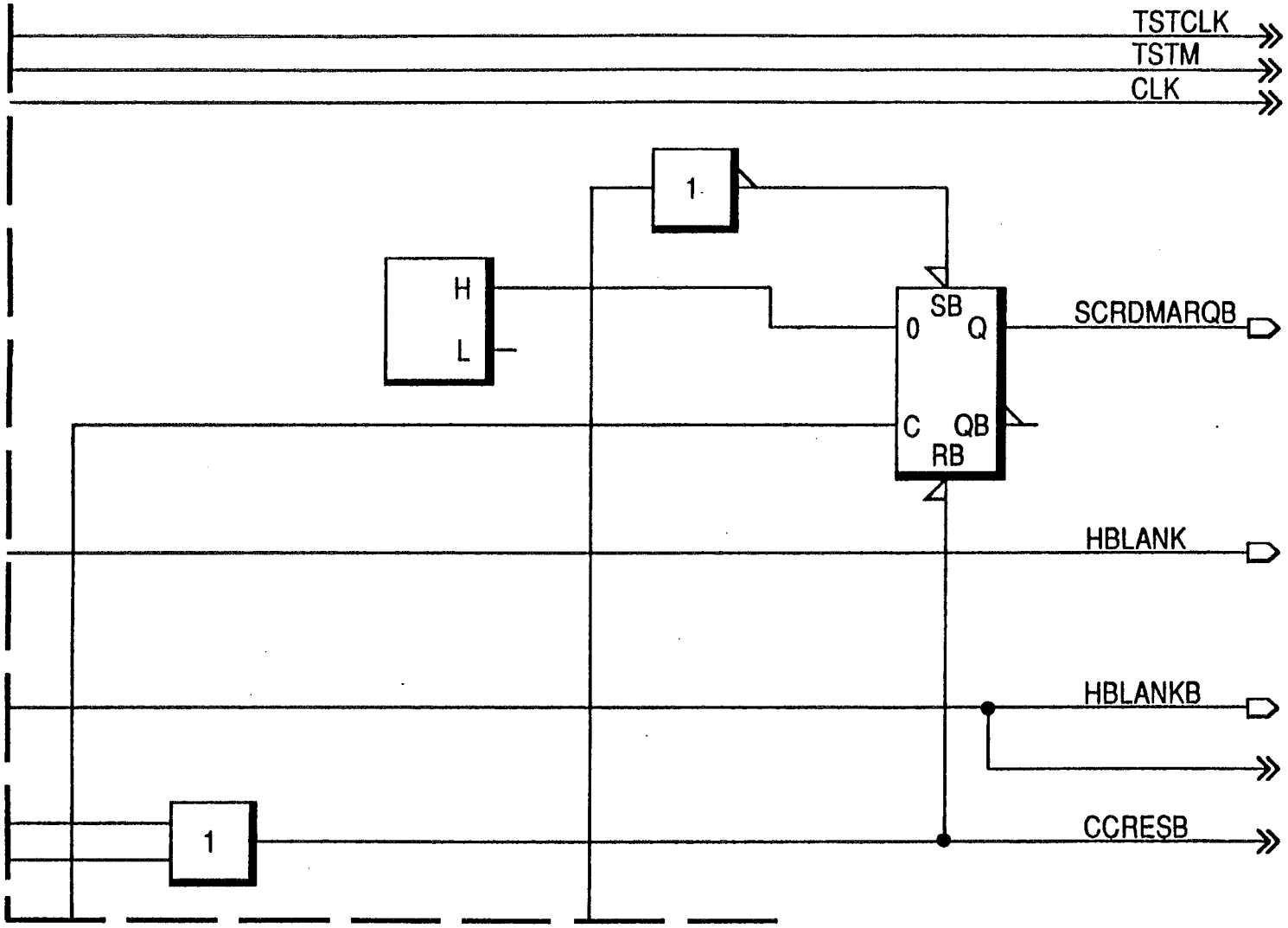
Figures 6, 6D:
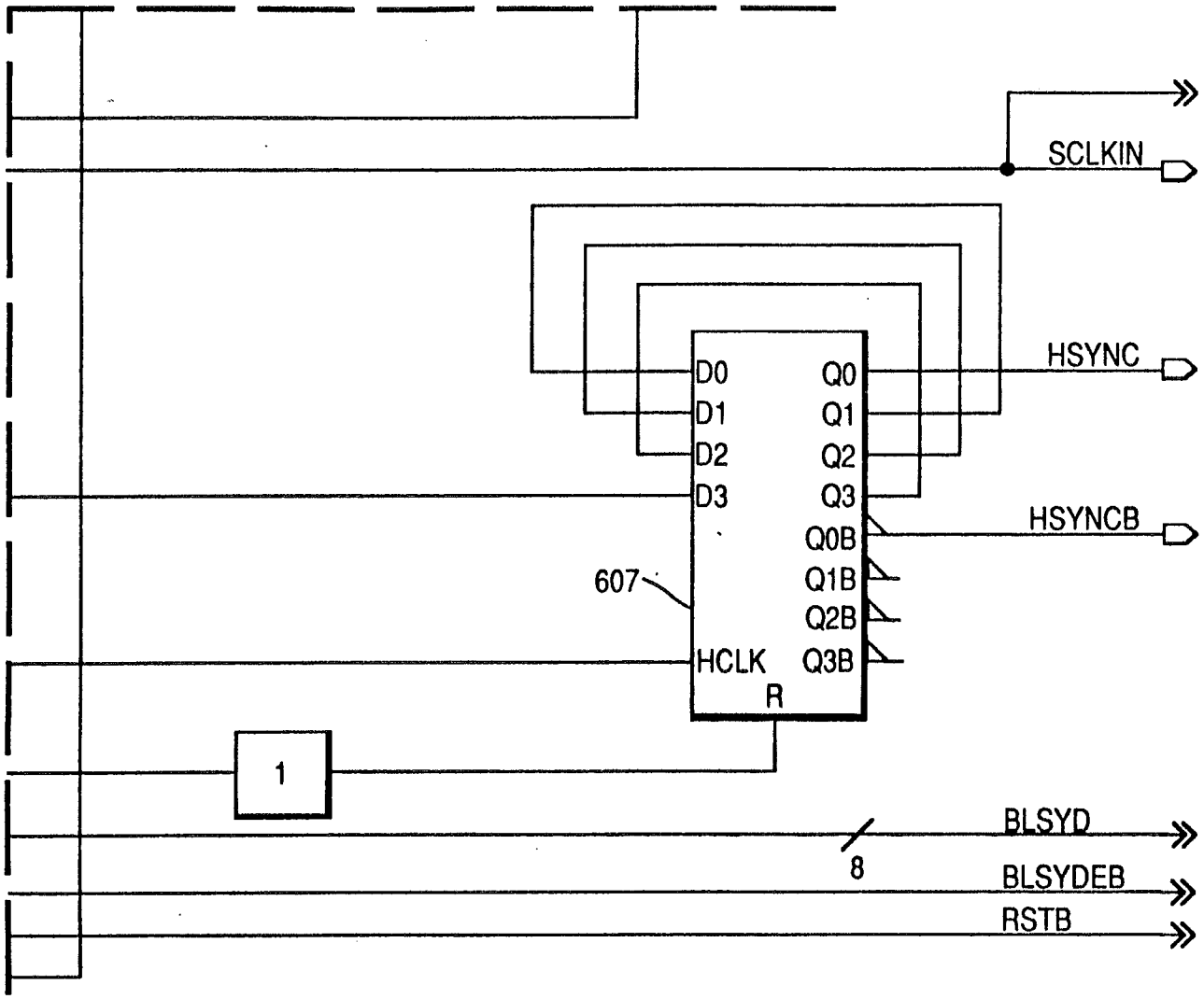
Figure 7A:
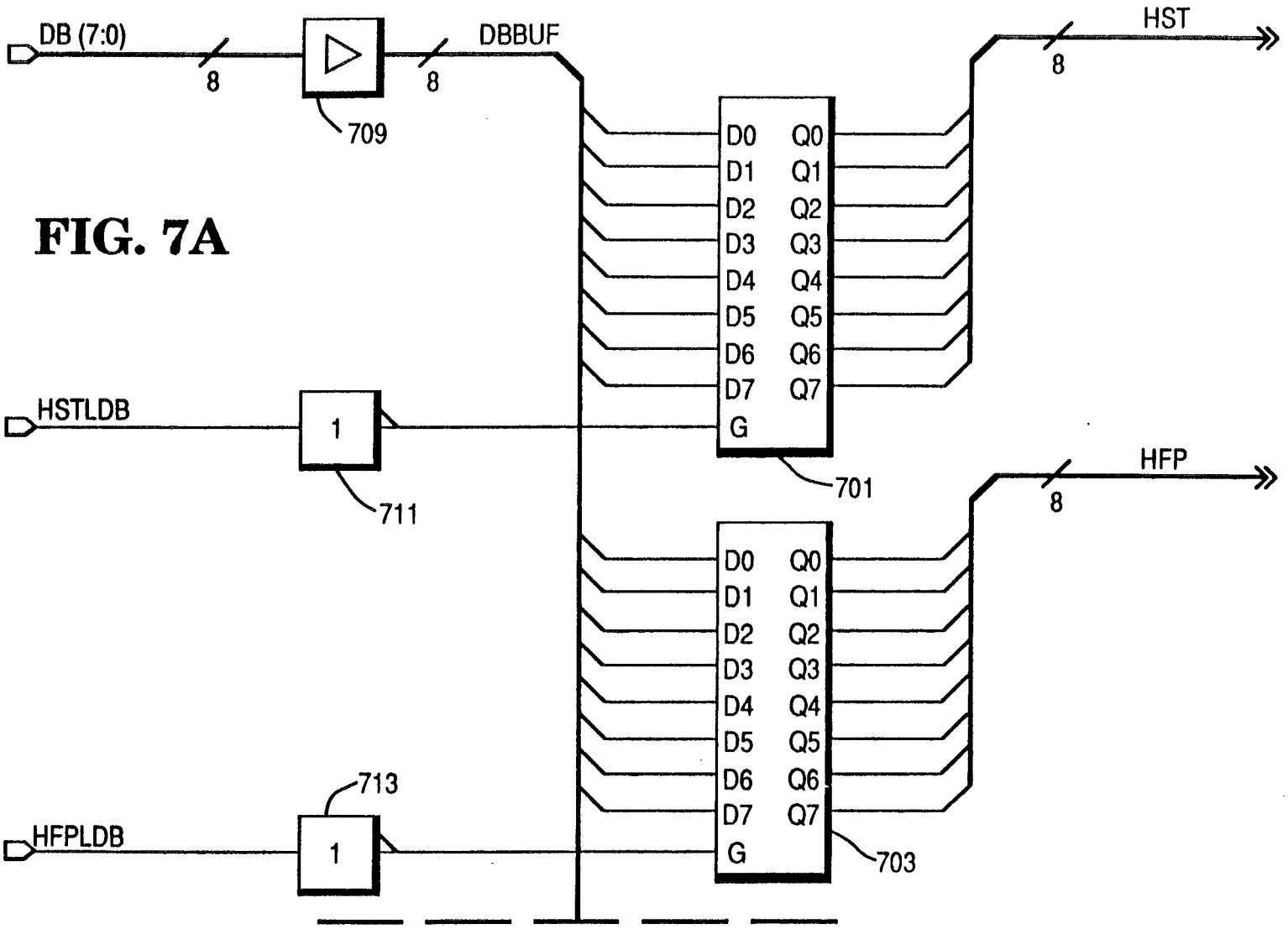
FIGS. 7 through 11 are detailed schematic diagrams of the horizontal blanking and synchronization circuitry shown in FIG. 6.
Figure 7B:
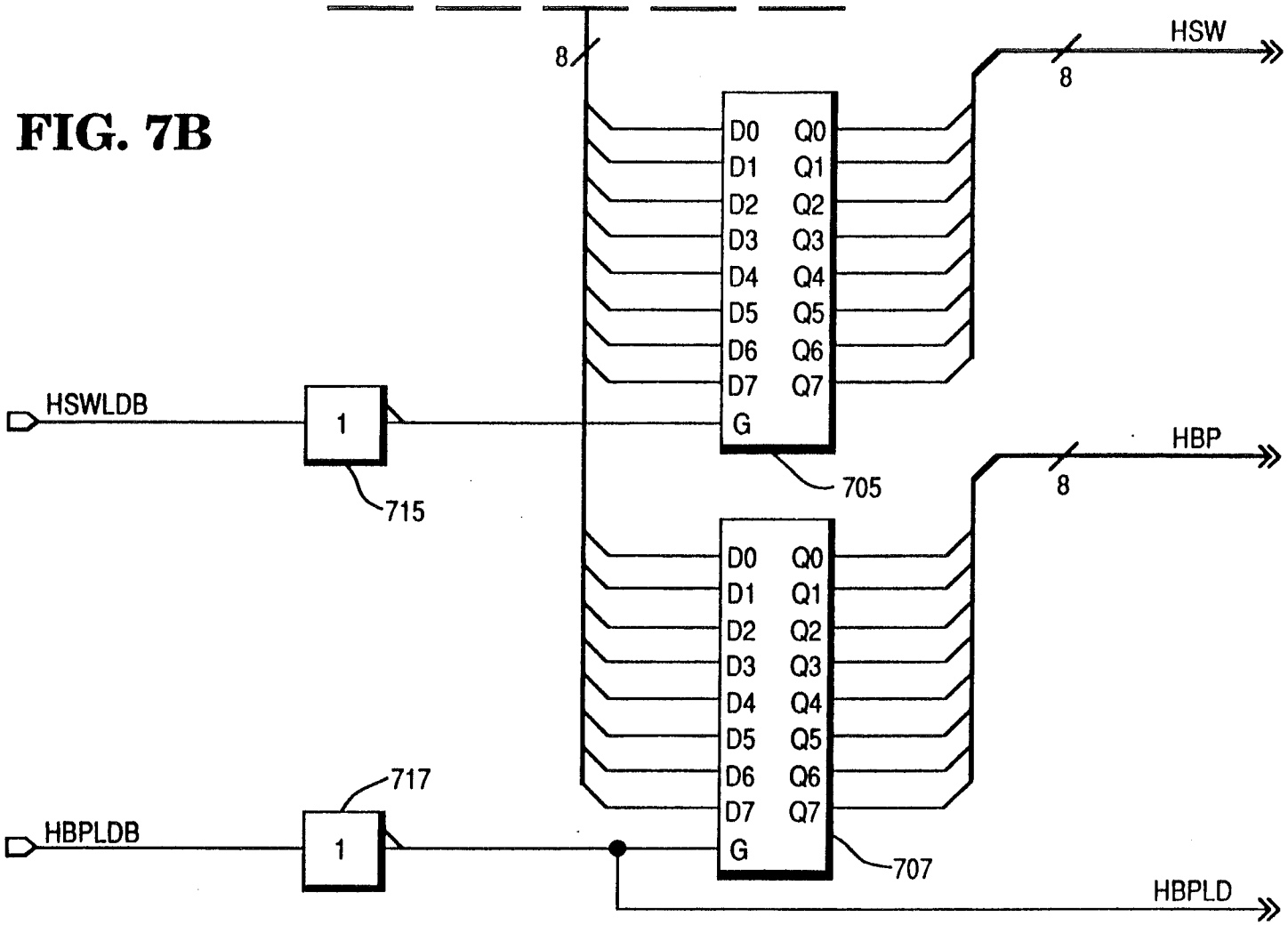

FIG. 6 provides a schematic diagram of horizontal timing logic block 101. Central to the circuit of FIG. 6 is horizontal blank and sync generator 601, the internal construction of which is discussed below. Blank and sync generator 601 is connected to receive as inputs an eight-bit data signal designated DB; a clock signal HCLK, load signals HSTLDB, HFPLDB, HSWLDB and HBPLDB; read signals HSTRDB, HFPRDB, HSWRDB, HBPRDB, and HCNTRRDB; signal CSYNC; test signals TSTM and TSTCLK; and reset signal RSTB. The output of blank and sync generator 601 are identified as blanking signals BLANK and BLANKB, synchronization signals SYNC and SYNCB, an eight-bit data out signal HDOUT, and a data output enable signal HDOUTENB. It should be noted that all signals having designations ending in the letter "B" are active LOW signals. Signals BLANKB and SYNCB are complements of signals BLANK and SYNC, respectively.

The clock signal HCLK is generated by the video logic block from the external clock signal HPC (half pixel clock). Signal HCLK has a frequency of one-eighth of the frequency of the video output signal VOUT.

Signal BLANK is provided to the D3 input of a four-bit register 603. The non-inverting outputs Q0 through Q3 and the inputs D0 through D3 are connected to each other and to an OR gate 605 in such a fashion that output Q0 is set to a HIGH level one HCLK clock cycle after signal BLANK goes HIGH, and is set to a LOW state four clock cycles after signal BLANK transitions to a LOW state. The output generated at Q0 of register 603 is identified as horizontal blanking signal HBLANK. The complement of signal HBLANK is provided at inverted output Q0B of register 603.

The horizontal synchronization signals HSYNC and HSYNCB are generated by a shift register 607 which is connected to receive signal SYNC from blank and sync generator 601 and clock signal HCLK. Signals HSYNC and HSYNCB are delayed versions of signals SYNC and SYNCB, respectively. A delay of four cycles of clock signal HCLK is produced by shift register 607.

The delays in the horizontal blanking and synchronization signals introduced by registers 607 and 607 are necessary in the particular embodiment shown in order to coordinate the signal transitions with other operations of the video controller.

FIGS. 7 through 11 provide a detailed schematic diagram of horizontal blank and sync generator 601. Referring now to FIGS. 7A and 7B, shown are four eight-bit registers 701, 703, 705 and 707. Each register is connected to receive a buffered version of eight-bit data signal DB at inputs D0 through D7. Register 701 is connected to receive the inverse of signal HSTLDB from inverter 711 at its latch input, designated G. Likewise, registers 703, 705 and 707 are connected to receive the inverse of load signals HFPLDB, HSWLDB and HBPLDB from inverters 713, 715 and 717, respectively.

Each register is responsive to receipt of a HIGH level signal at its G input to latch and hold the data then present at its D0 through D7 inputs. The stored data is maintained at outputs Q0 through Q7 until such time as new data is latched into the register. The eight-bit output signals provided by registers 701 through 707 are referred to as HST, HFP, HSW and HBP, respectively.

Figure 8:
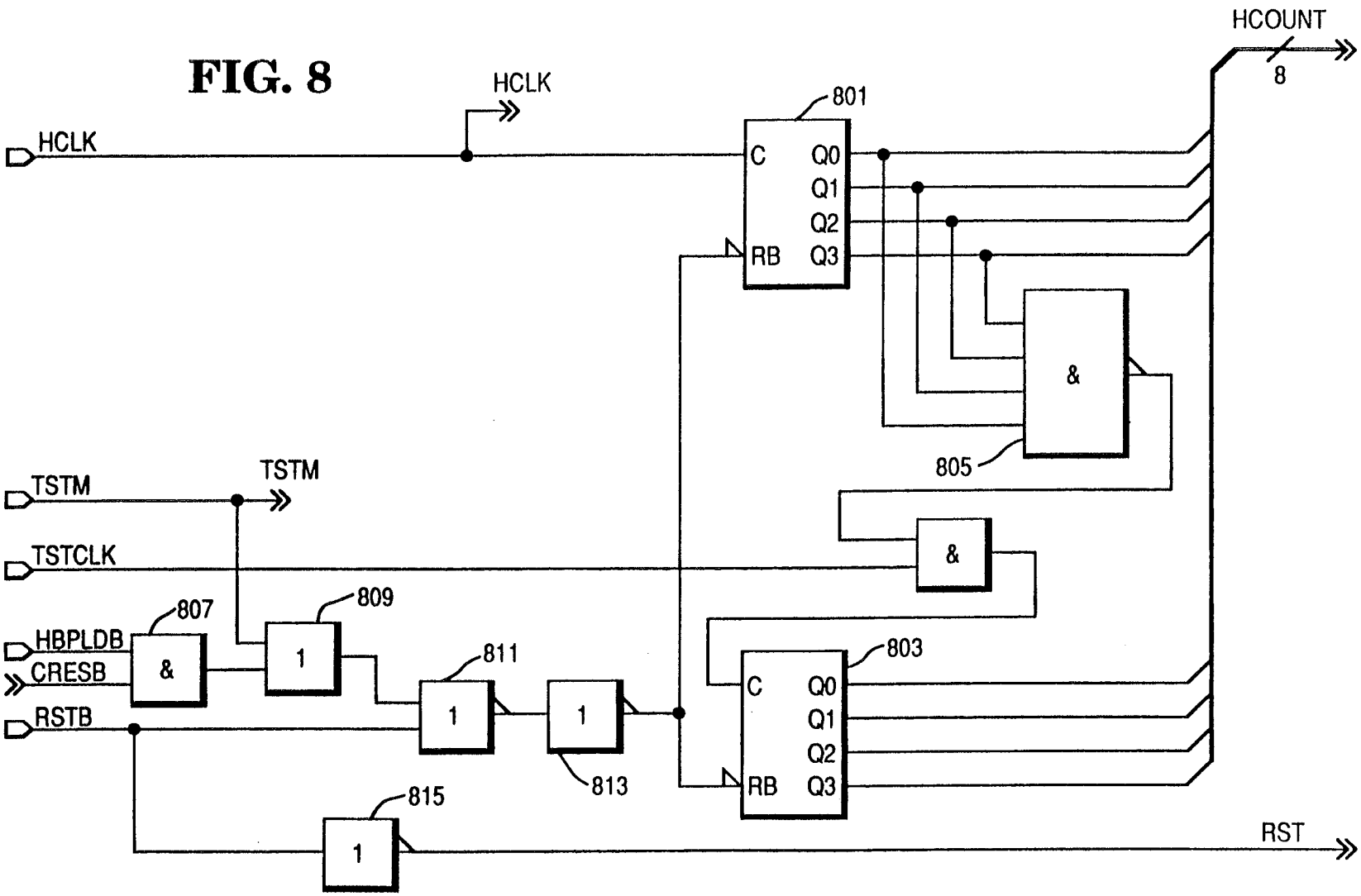

FIG. 8 illustrates circuitry for counting signal HCLK clock pulses. The circuit includes two four-bit binary counters 801 and 803. Counter 801 is connected to receive signal HCLK to generate the four least significant bits of the eight-bit signal HCOUNT. The four bits generated by counter 801 are also provided to AND gate 805, the output of which forms the input to counter 803. Counter 803 generates the four most significant bits of signal HCOUNT. Gates 807 through 813 form a portion of the circuitry used to test the operation of the horizontal and vertical timing logic circuits.

Figure 9:
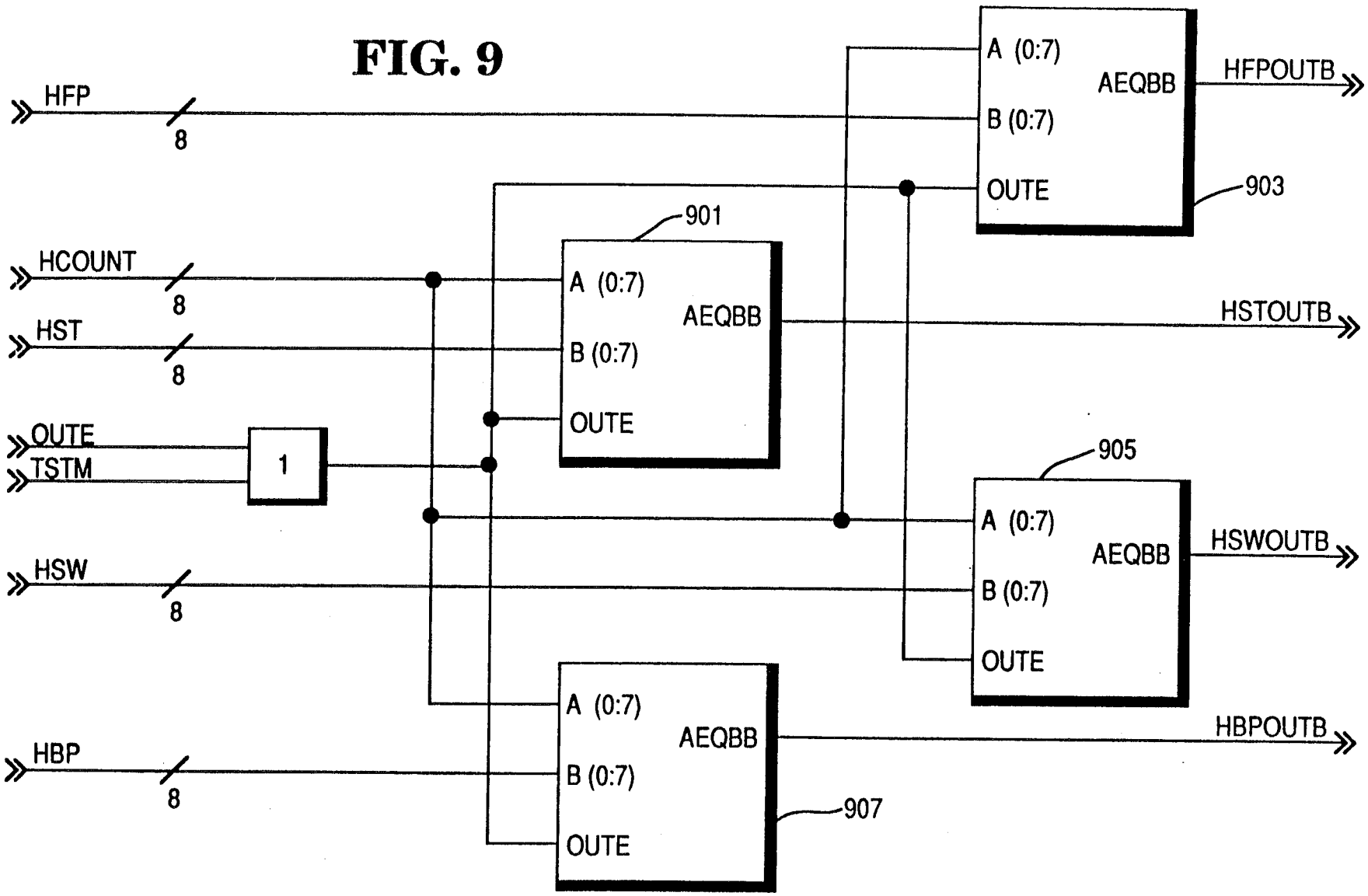

Comparators 901, 903, 905 and 907, shown in FIG. 9, each receive signal HCOUNT and a respective one of signals HST, HFP, HSW and HBP. The outputs of each of comparators 901, 903, 905 and 907, designated HSTOUTB, HFPOUTB, HSWOUTB and HBPOUTB, respectively, are normally at a HIGH level but are set to a LOW state when the two eight-bit signals received as inputs are equivalent.

Figure 10:
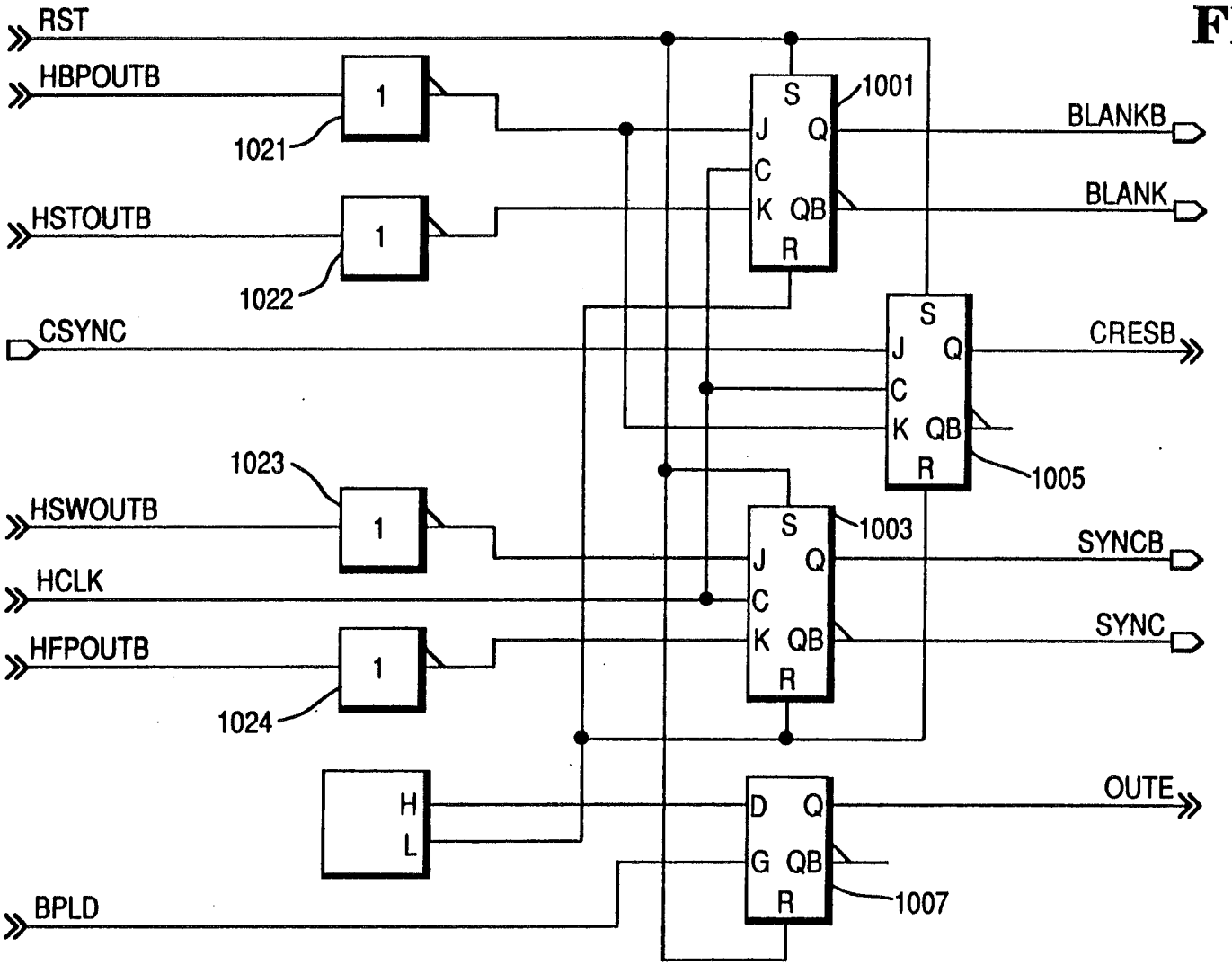

The output signals generated by comparators 901, 903, 905 and 907 are inverted and provided to clocked flip-flops 1001 and 1003 as shown in FIG. 10. Signals HBPOUTB and HSTOUTB are provided through inverters 1021 and 1022 to the J and K inputs of flip-flop 1001, respectively, and signals HSWOUTB and HFPOUTB are provided through inverters 1023 and 1024 to the J and K inputs of flip-flop 1003, respectively. Flip-flop 1001 generates signals BLANK and BLANKB while flip-flop 1003 produces signals SYNC and SYNCB. Signal BLANK is set to a HIGH state when signal HSTOUTB goes LOW, and set to a LOW state when signal HBPOUTB goes LOW. Similarly, signal SYNC is set to a HIGH state when signal HFPOUTB goes LOW, and reset to a LOW state when signal HSWOUTB goes LOW.

Figure 11:
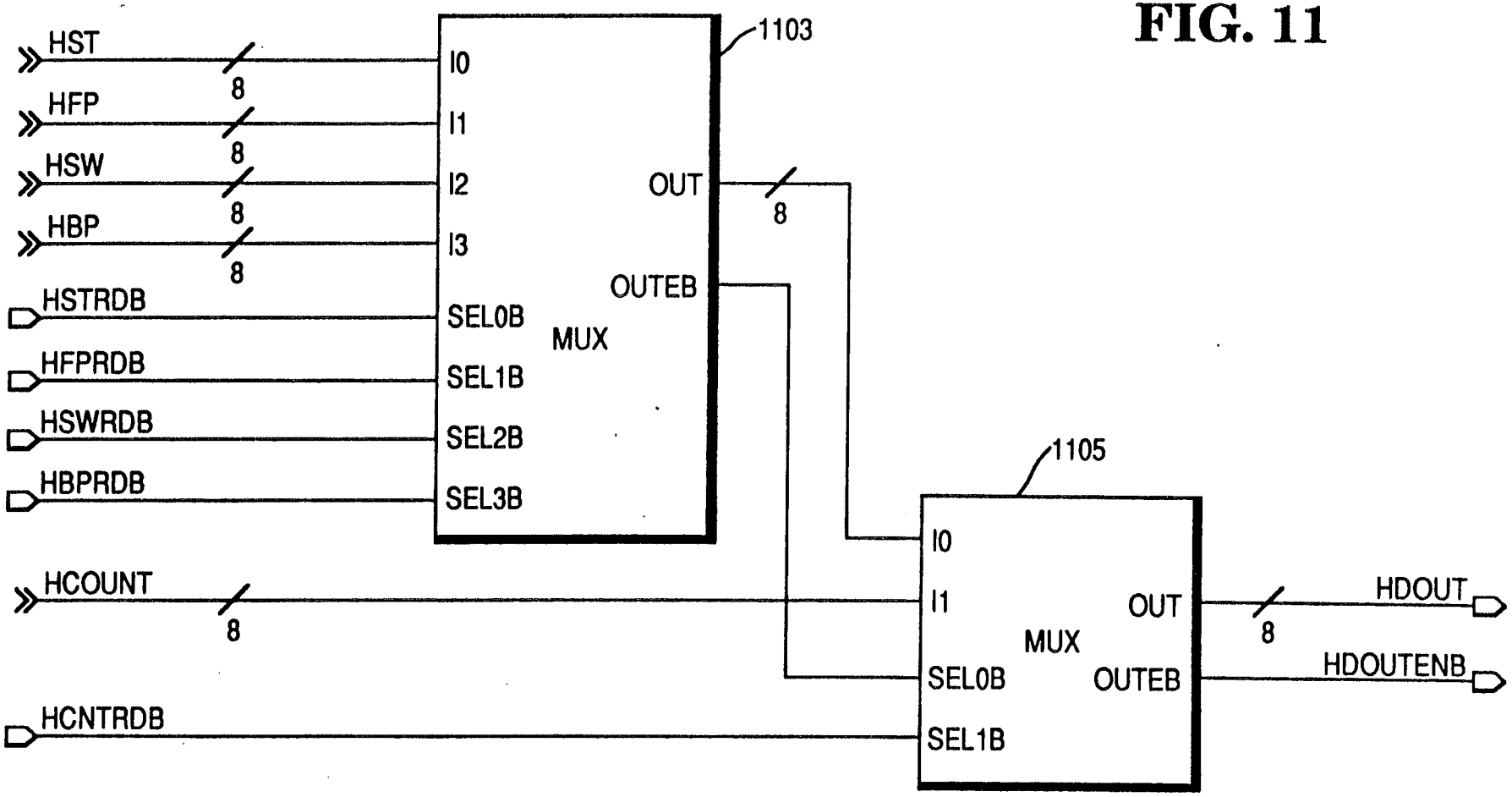

Multiplexers 1103 and 1105 of FIG. 11 are included in the horizontal logic circuit to permit data to be read from storage in registers 701 through 707, shown in FIG. 7, or to obtain the value of HCOUNT. Setting one of signals HSTRDB, HFPRDB, HSWRDB, HBPRDB or CNTRDB, provides a respective one of signals HST, HFP, HSW, HBP or HCOUNT to the eight-bit output bus identified as HDOUT.

Vertical Timing Logic

Figure 12:
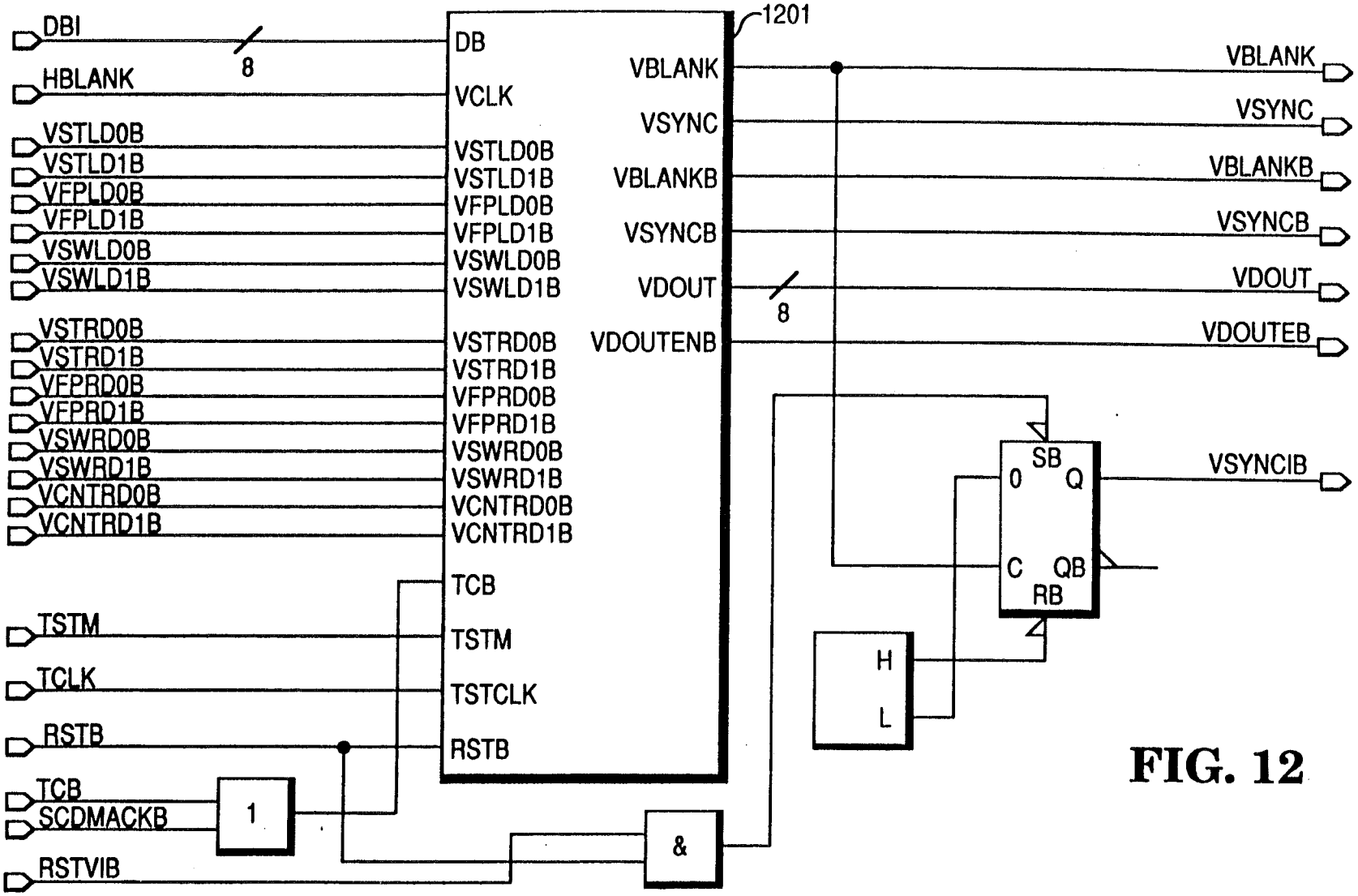
FIG. 12 is a schematic diagram of the vertical timing logic block shown in FIGS. 1 and 2.

Referring now to FIG. 12, a schematic diagram of the vertical timing logic is shown. The circuit includes a vertical blank and sync generator 1201 which is connected to receive as inputs eight-bit data signals from bus DB; signal HBLANKB from the horizontal timing logic circuit shown in FIG. 6; load signals VSTLD0B, VSTLD1B, VFPLD0B, VFPLD1B, VSWLD0B and VSWLD1B; read signals VSTRD0B, VSTRD1B, VFPRD0B, VFPRD1B, VSWRD0B, VSWRD1B, VCNTRRD0B and VCNTRRD1B; terminal count signal TCB, test signals TSTM and TSTCLK; and reset signal RSTB. Signal HBLANKB is the clock signal for the vertical blank and sync generator circuit. HBLANKB is designated as VCLK in FIGS. 12 through 19. The vertical blank and sync generator provides as outputs vertical blanking signals VBLANK and VBLANKB, vertical synchronization signals VSYNC and VSYNCB, an eight-bit data out signal VDOUT, and a data output enable signal VDOUTENB.

Figure 13:
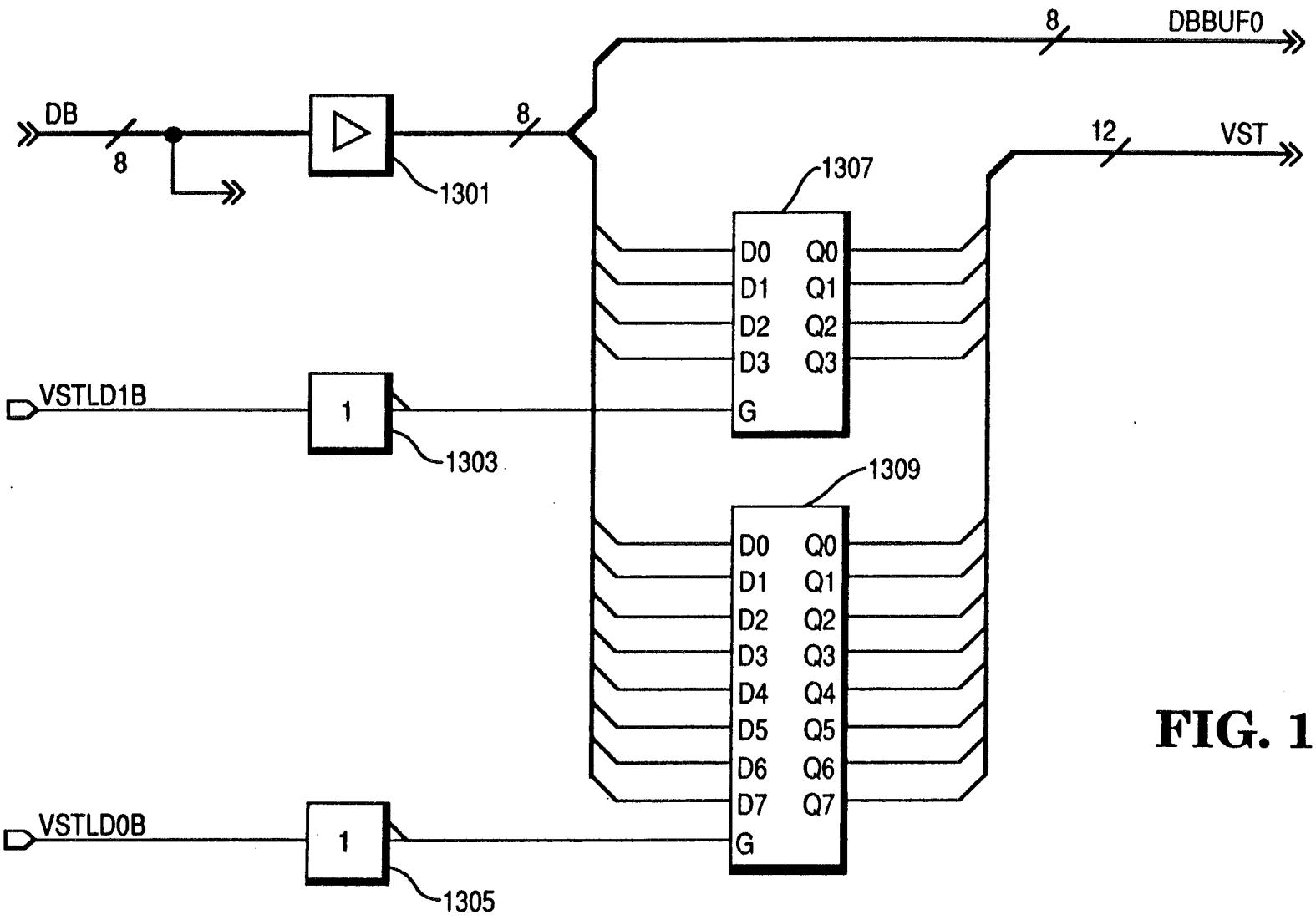
FIGS. 13 through 19 are detailed schematic diagrams of the vertical blanking and synchronization circuitry shown in FIG. 12.

FIGS. 13 through 19 provide a detailed schematic diagram of the internal circuitry of blank and sync generator 1201. Shown in FIG. 13 are two registers for storing a twelve-bit data signal VST. Four-bit register 1307 is connected to receive the four least significant bits of DB from data buffer 1301 and the inverse of signal VSTLDlB from inverter 1303. Upon receipt of a HIGH level signal from inverter 1303 register 1307 latches and holds the four bits of information then provided by DB. Eight-bit register 1309 is connected to receive all eight bits of DB from data buffer 1301 and the inverse of signal VSTLD0B from inverter 1305. Register 1309 is responsive to a LOW state signal generated by inverter 1305 to store the eight bits of data then present at its data inputs. The four bits of output provided by register 307 is combined with the eight bits of output provided by register to produce VST.

Figure 14:
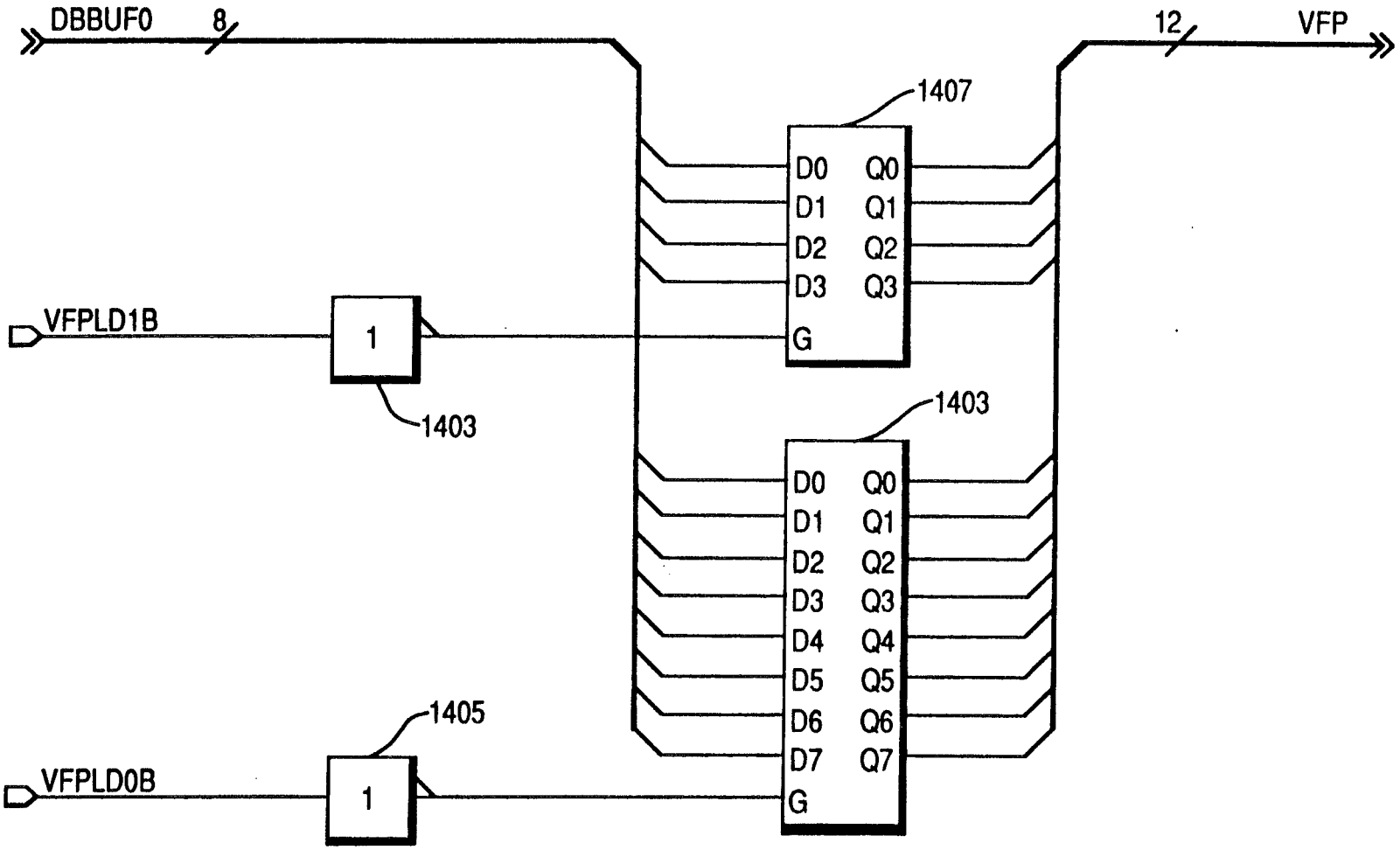
Figure 15:
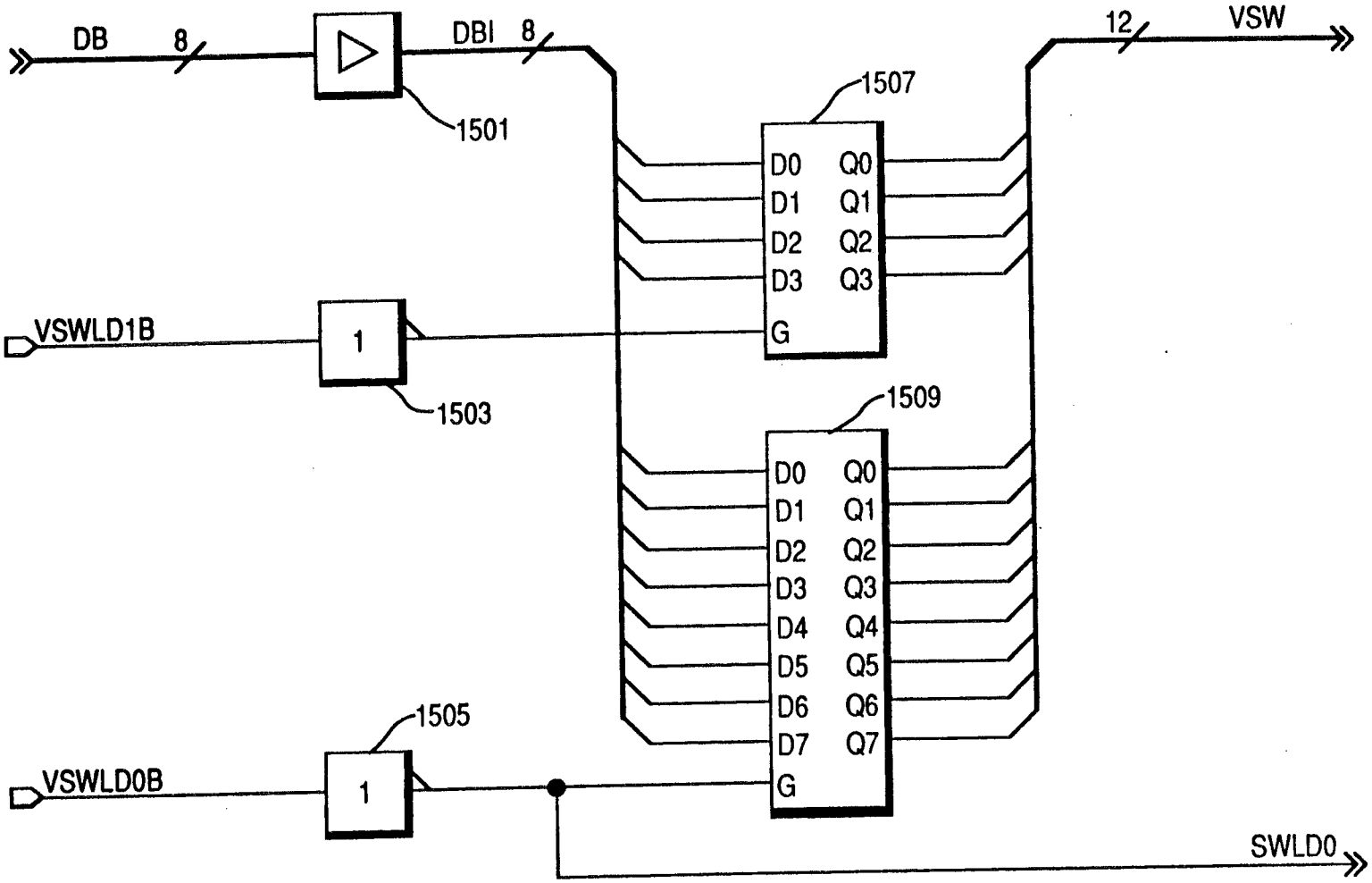

FIGS. 14 and 15 show structure similar to that shown in FIG. 13 for saving and storing twelve-bit signals VFP and VSW.

Figure 16A:
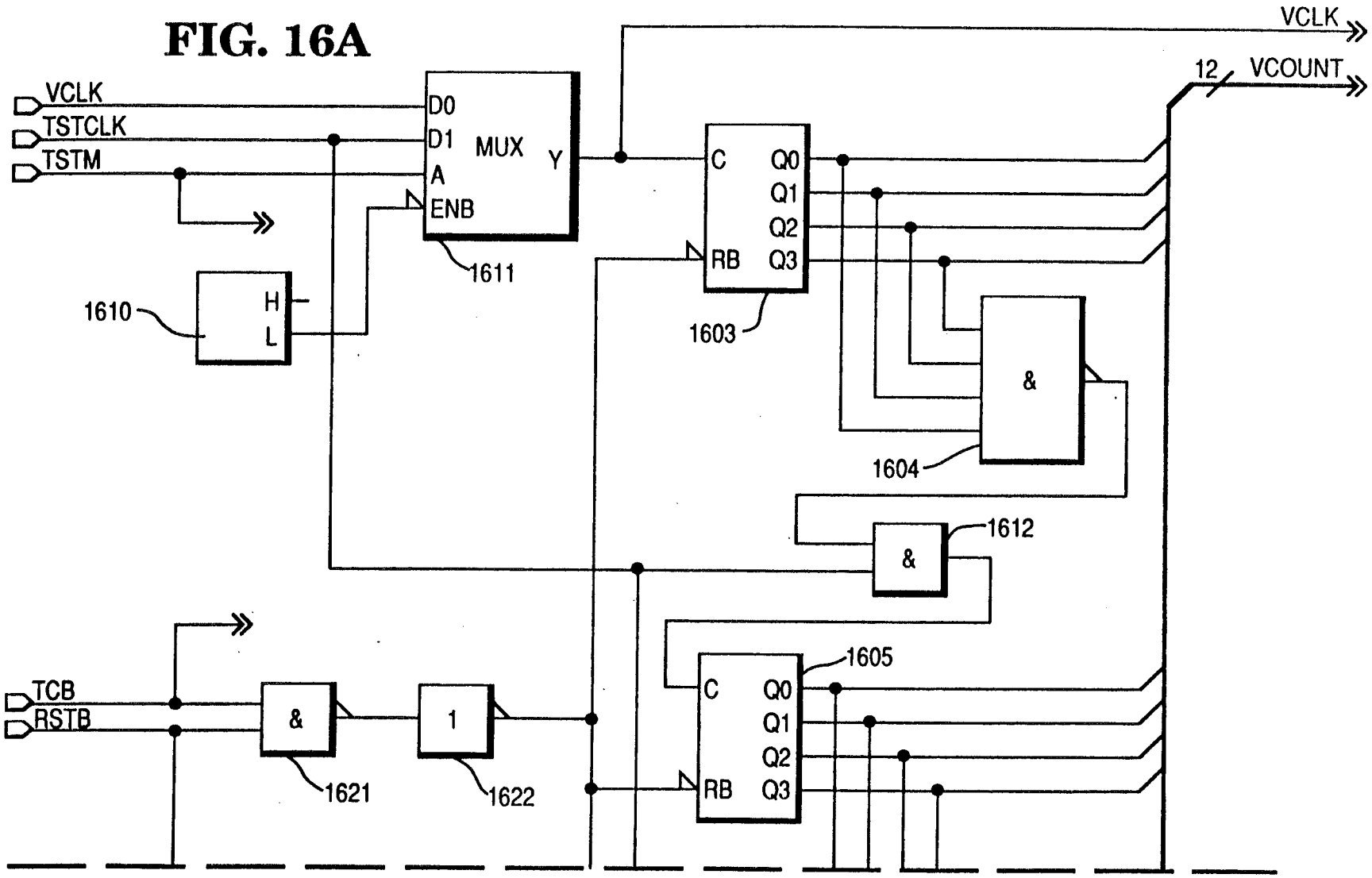
Figure 16B:
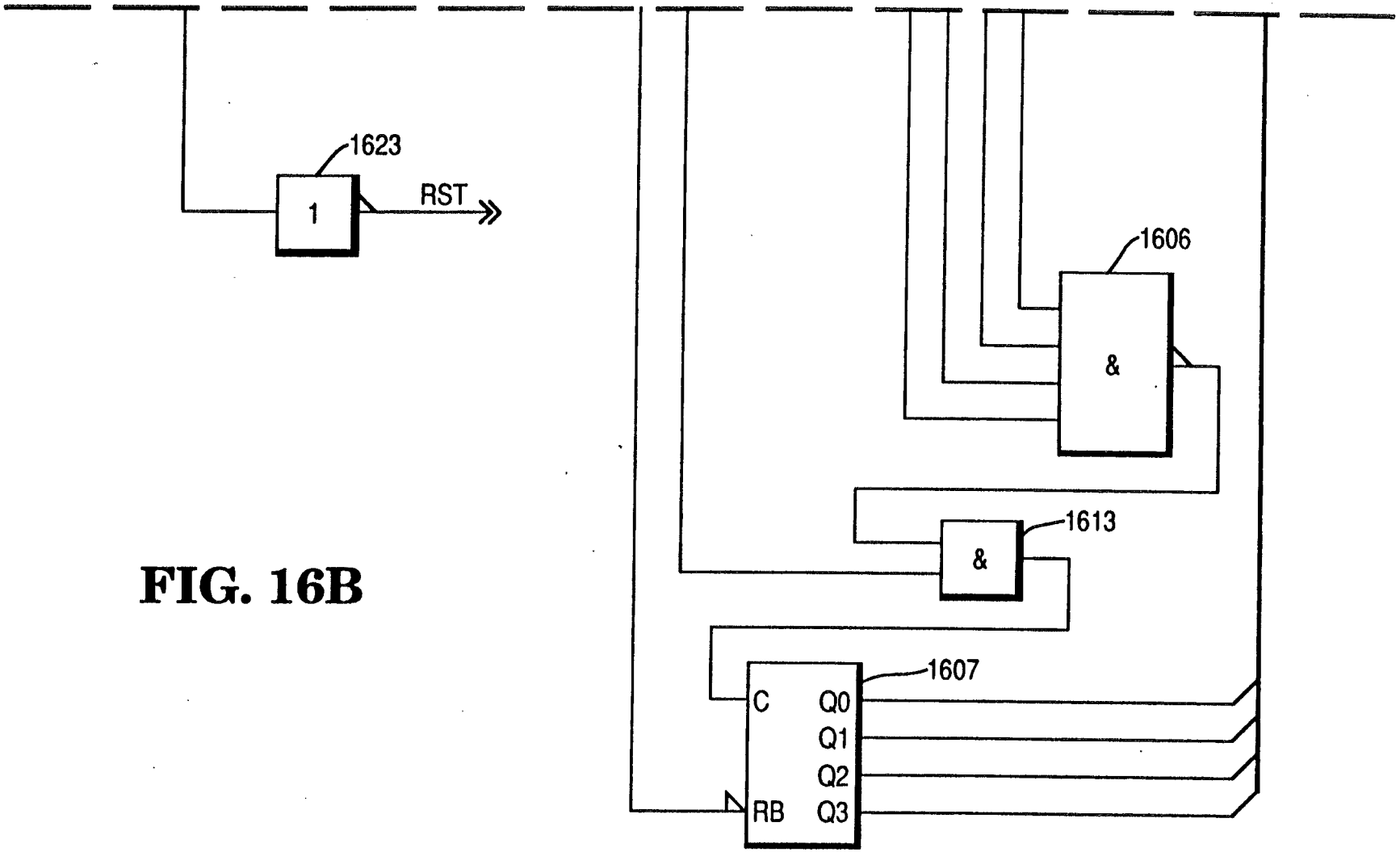

Circuitry for counting signal VCLK clock pulses is shown in FIGS. 16A and 16B. Signal VCLK is passed through a multiplexer 1611 to the input of a first four-bit counter 1603. The four outputs of counter 1603 are gated together by AND gate 1604, the output of which is provided to a second four-bit counter 1605. The outputs of the second counter are gated together by AND gate 1606 to form the input to a third counter 1607. Combined, the outputs of counters 1603, 1605 and 1607 form the twelve-bit signal VCOUNT.

Figure 17:
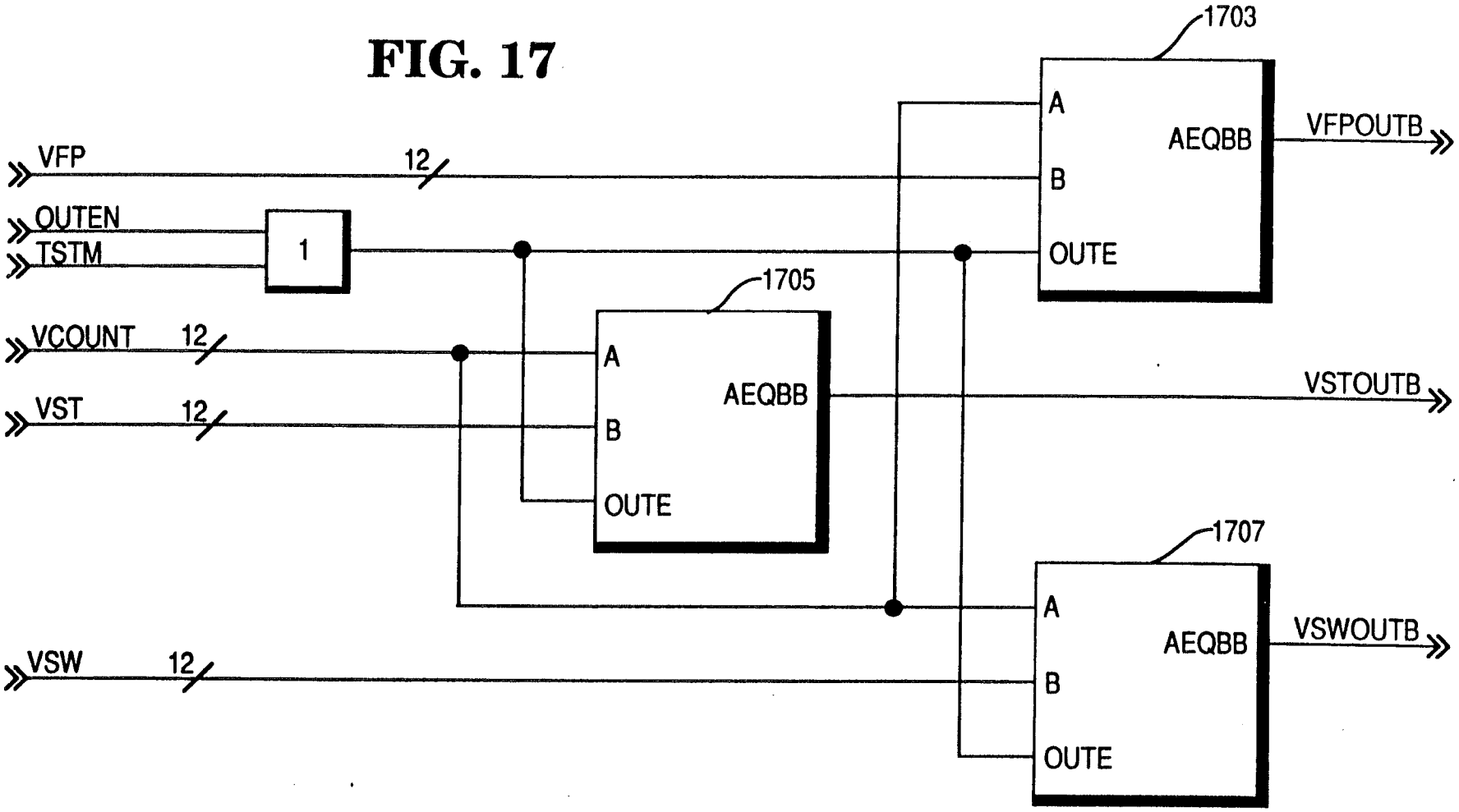

Signals VFP, VST and VSW are provided to comparators 1701, 1703 and 1705, respectively, as illustrated in FIG. 17. Each signal is compared to signal VCOUNT which is also provided to each comparator. The outputs of each of comparators 1703, 1705 and 1707, designated VFPOUTB, VSTOUTB and VSWOUTB, respectively, are normally at a HIGH level but are set to a LOW state when the two twelve-bit signals received as inputs are equivalent.

Figure 18:
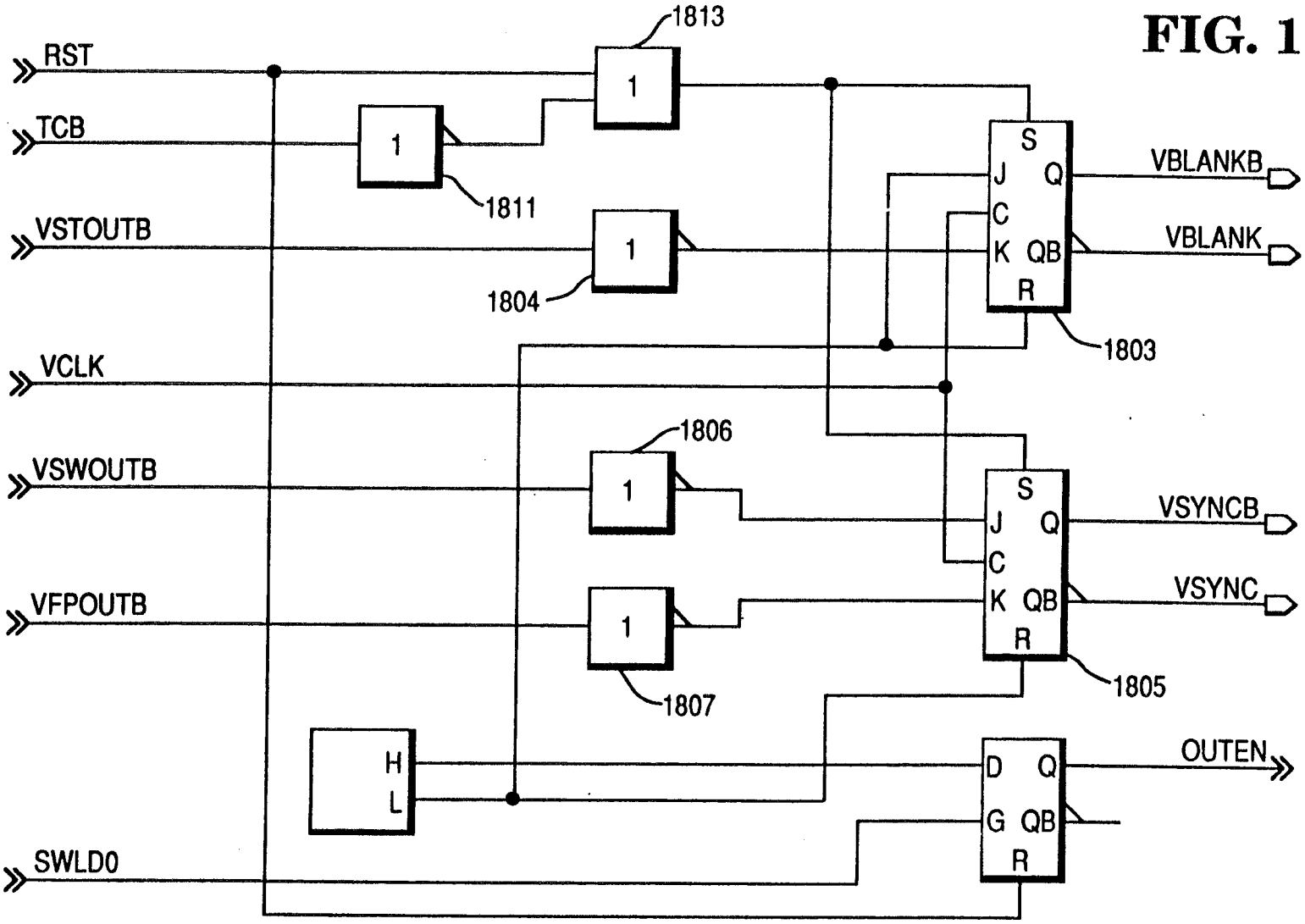

Vertical blanking signals VBLANK and VBLANKB are generated by flip-flop 1803 shown in FIG. 18. Signal VSTOUTB is provided through an inverter 1804 to the K input of flip-flop 1803. The J input of flip-flop 1803 is connected to a LOW signal source. A second flip-flop 1805 generates vertical synchronization signals VSYNC and VSYNCB from signals VSWOUTB and VFPOUTB. Signals VSWOUTB and VFPOUTB are applied through inverters 1806 and 1807 to the J and K inputs, respectively of flip-flop 1805. An OR gate 1813 is connected to receive reset signal RST and the inverse of terminal count signal TCB, which will be discussed below. Signal VBLANK, provided at the QB output of flip-flop 1803, is set to a HIGH state when VSTOUTB goes LOW. Signal SYNC, produced at output QB of flip-flop 1805 is set to a HIGH state when signal VFPOUTB goes LOW, and reset to a LOW state when signal VSWOUTB goes LOW. The QB outputs of both flip-flops are set to a LOW state when signal TCB goes LOW or signal RST goes HIGH.

Figure 19:
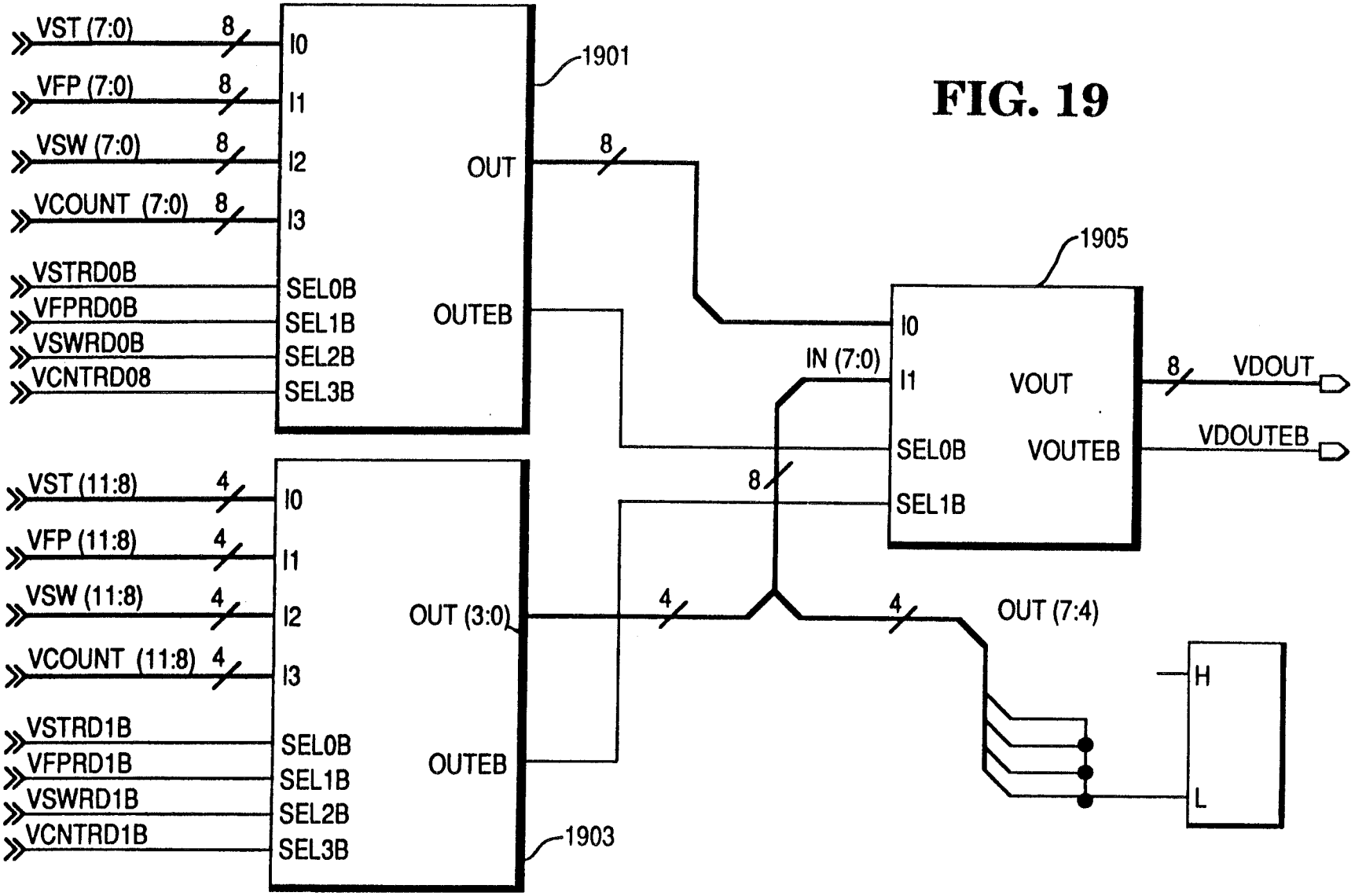

FIG. 19 illustrates circuitry which allows data to be read out of the storage registers shown in FIGS. 13 through 15. Four-to-one multiplexer 1901 is connected to receive the eight least-significant bits of signals VST, VFP, VSW and VCOUNT and the four read signals VSTRD0B, VFPRD0B, VSWRD0B and VCNTRD0B. Four-to-one multiplexer 1903 is connected to receive the four most-significant bits of signals VST, VFP, VSW and VCOUNT and the four read signals VSTRD1B, VFPRD1B, VSWRD1B and VCNTRD1B. Setting one of the read signals LOW provides a respective portion of one of the signals VST, VFP, VSW or VCOUNT to the eight-bit output bus identified as VDOUT.

Circuit Operation

Generation of the proper horizontal and vertical synchronization and blanking pulses by the video controller for a particular video display monitor requires that the horizontal registers, shown in FIG. 7 as elements 701, 703, 705 and 707, and the vertical storage registers, shown in FIGS. 13 through 15 as elements 1307, 1309, 1407, 1409, 1507 and 1509, be loaded with pixel count and line count information corresponding to the monitor being driven.

The following equations map the desired monitor screen resolution parameters to the values to be loaded into the registers.

$$HST=(HHPP-HFPP-HSPP-HBPP)/8$$

$$HFP=[(HHPP-HSPP-HBPP)/8]-2$$

$$HSW=[(HHPP-HBPP)/8]-4$$

$$HBP=(HHPP/8)-3$$

$$VST=(VVPP-VFPP-VSPP-VBPP)-1$$

$$VFP=(VVPP-VSPP-VBPP)-1$$

$$VSW=(VVPP-VBPP)-1$$

where:

HHPP=total number of horizontal pixels in each scan line, including blanking;

HFPP=total number of pixels in the horizontal front porch, i.e. the area between the the start of horizontal blanking and the beginning of horizontal synchronization;

HSPP=total number of pixels in the horizontal synchronization pulse;

HBPP=total number of pixels in the horizontal back porch, i.e. the area between the end of horizontal synchronization and end of horizontal blanking;

VVPP=total number of horizontal lines including blanking;

VFPP=total number of lines in the vertical front porch, i.e. the number of lines between the start of vertical blanking and the begining of vertical synchronization;

VSPP=total number of lines in the vertical synchronization pulse; and

VBPP=total number of lines in the vertical back porch, i.e. the number of lines between the end of vertical synchronization and the end of vertical blanking.

After determination of the proper values for HST, HFP, HSW, HBP, VST, VFP and VSW, the pixel and line counts are stored in the horizontal and vertical storage registers by successively placing the values onto data bus DB while enabling the respective registers by setting load signals HSTLDB, HFPLDB, HSWLDB, HBPLDB, VSTLD0B, VSTLD1B, VFPLD0B, VFPLD1B, VSWLD0B, and VSWLD1B. Line count values VST, VFP and VSW are divided into eight and four bit segments for storage.

During display operations, the circuitry shown in FIG. 8 counts signal HCLK clock pulses, each pulse being associated with the display of eight pixels. The eight-bit output of the counting circuitry, HCOUNT is provided to the comparators shown in FIG. 9. The comparators generate four normally high signals. Signal HSTOUTB is set low when HCOUNT equals HST, signifying the beginning of horizontal blanking. Signals HFPOUTB is set low when signals HCOUNT and HFP are equal, signifying the start of horizontal synchronization. Signals HSWOUTB and HBPOUTB are set low when signals HSW and HBP, respectively, are equal to HCOUNT, indicating the end of synchronization and blanking. Signal HBPOUTB is also utilized to reset the horizontal counting circuitry at the conclusion of each horizontal scan cycle.

Flip-flop 1001 of FIG. 10 generates a blanking signal BLANK which is set to a high state when HSTOUTB goes low, and set to a low state when HBPOUTB goes low. Similarly, flip-flop 1003 generates a synchronization signal SYNC which is set to a high state when HFPOUTB goes low, and set to a low state when SWPOUTB goes low. The horizontal blanking and synchronization signals HBLANK and HSYNC output by registers 605 and 607 of FIG. 6 are delayed versions of signals BLANK and SYNC.

Horizontal blanking signal HBLANK is provided to the vertical timing circuit to provide timing for the line counting circuitry shown in FIG. 16. The twelve-bit output of the line counting circuitry, VCOUNT is compared to the stored line count values VST, VFP and VSW by the comparators shown in FIG. 17 to generate signals VSTOUTB, VFPOUTB and VSWOUTB.

Flip-flops 1803 and 1805 of FIG. 18 produce the vertical blanking and synchronization signals VBLANK and VSYNC. VSYNC is set high when VFPOUTB goes low, and set low when VSWOUTB goes low. VBLANK is set high when VSTOUTB goes low, and reset to a low state when terminal count signal TCB is set to a low state. Signal TCB is an active low signal which indicates the termination of a screen display scan sequence. It occurs at the end of vertical blanking.

Figure 20:
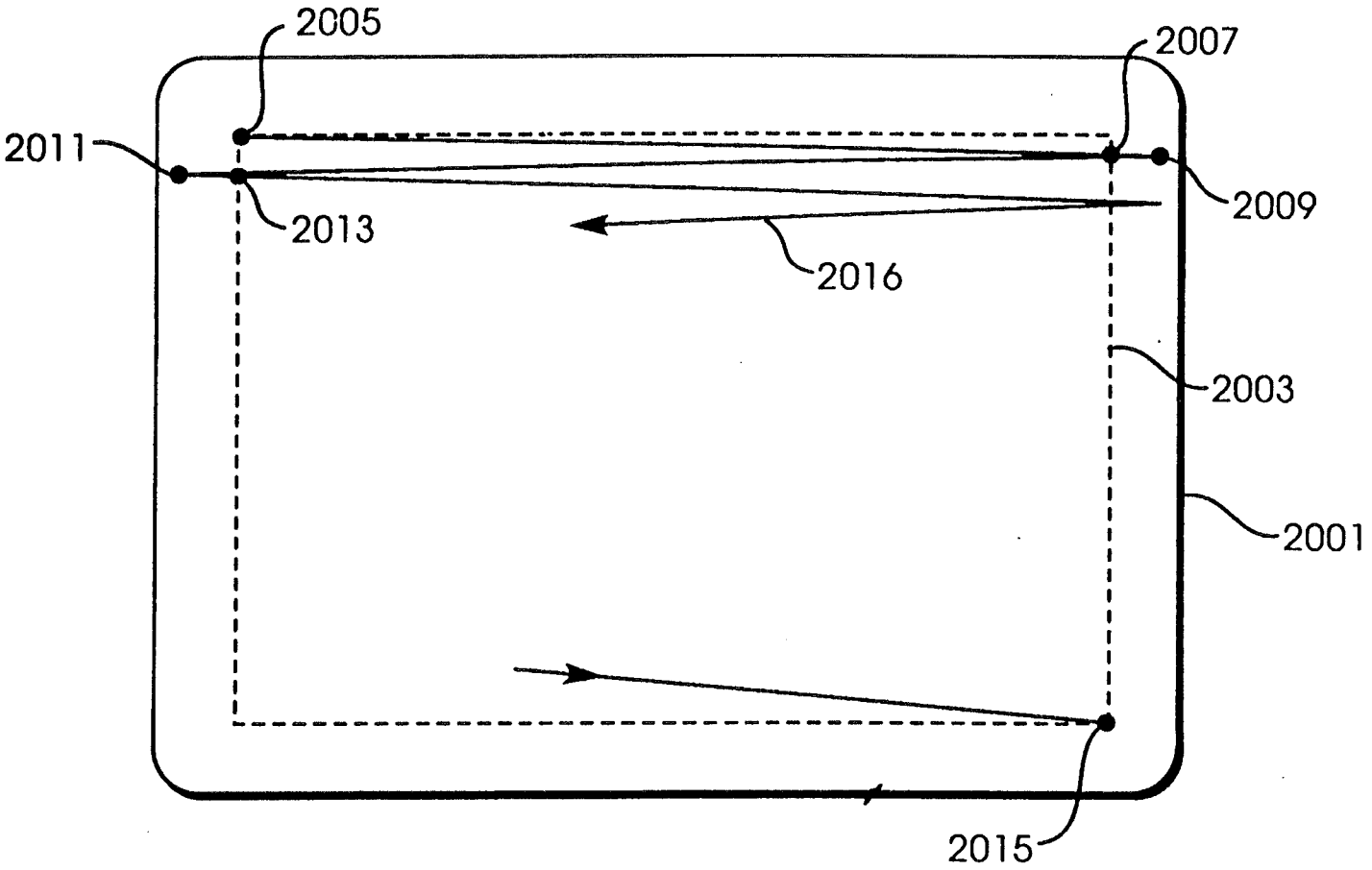
FIG. 20 illustrates the raster scan operation performed by the video controller and monitor.

FIG. 20 is provided to illustrate the screen display scan sequence. Element 2001 is the screen of a monitor and box 2003 is the area of the screen utilized for displaying information. The area outside of box 2003 but within screen 2001 forms a black border around the display area. The scan path is shown, greatly exaggerated, by line 2016.

The display sequence begins at point 2005. Both HCOUNT and VCOUNT are set to zero at this time. Pixels are displayed beginning at point 2005 and continuing to point 2007, at which time HCOUNT equals HST and horizontal blanking begins. Horizontal synchronization begins at point 2009 when HCOUNT equals HFP and ends at point 2011 when HCOUNT equals HSW. Video blanking continues through the horizontal retrace operation initiated by the horizontal synchronization signal, until point 2013 when HCOUNT equals HBP. At point 2013, the horizontal pixel count HCOUNT is reset to zero and a second line scan begins. The line count VCOUNT is incremented by one upon the conclusion of each horizontal blanking operation.

At point 2015, VCOUNT equals VST and vertical blanking starts, with vertical synchronization (retrace) beginning shortly thereafter when VCOUNT equals VFP. At the conclusion of vertical synchronization and blanking VCOUNT and HCOUNT are both reset to zero and a new screen scan begins at point 2005.

Possible pixel and line count parameters for several monitors having the resolution and operating frequencies shown are provided in the table below. All values shown are in hexadecimal and were determined through use of the equations provided above.

| | ADI 15" 1024 × 800 60 hz | Sampo 15" 1024 × 800 76 hz | Sampo 19" 1280 × 1024 60 hz | Sampo 19" 1280 × 1024 70 hz |
|---|---|---|---|---|
| HST | 80 | 80 | A0 | A0 |
| HFP | 82 | 86 | A8 | A2 |
| HSW | 98 | 94 | BA | B4 |
| HBP | A5 | A5 | D5 | CD |
| VST | 31F | 31F | 3FF | 3FF |
| VFP | 31F | 323 | 3FF | 402 |
| VSW | 327 | 327 | 403 | 405 |

The parameters provided above are meant to be exemplary only. Monitors having resolutions and frequencies other than those shown can also be driven by the video controller described above. However, larger storage registers would be required to accomodate monitors having horizontal resolutions greater than approximately 2048 or vertical resolutions greater than approximately 4096.

It can thus be seen that there has been provided by the present invention a novel video controller circuit which can be programmed to drive video monitors having different resolutions or frequencies.

From the foregoing specification it will be clear to those skilled in the art that the present invention is not limited to the specific embodiment described and illustrated and that numerous modifications and changes are possible without departing from the scope of the present invention. For example, the horizontal counting circuit counts pixels in groups of eight and vertical counting pulses. Either counting circuit could be modified to track other parameters which are proportional to the pixel clock.

These and other variations, changes, substitutions and equivalents will be readily apparent to those skilled in the art without departing from the spirit and scope of the present invention. Accordingly, it is intended that the invention to be secured by Letters Patent be limited only by the scope of the appended claims.

What is claimed is:

1. A programmable video controller for receiving pixel information from an external source and driving a video monitor, said video monitor including means for scanning said pixel information onto a video screen, said video controller comprising:

first programmable storage means for storing a first pixel count value associated with the beginning of horizontal blanking, a second pixel count value associated with the beginning of horizontal synchronization, a third pixel count value associated with the end of horizontal synchronization, and a fourth pixel count value associated with the end of horizontal blanking;

second programmable storage means for storing a first line count value associated with the beginning of vertical blanking, a second line count value associated with the beginning of vertical synchronization, and a third line count value associated with the end of vertical synchronization;

pixel counting means connected to receive a clock signal associated with said pixel information from said external source for counting pixels as they are provided by said external source to said controller;

first comparing means connected to said first storage means and said pixel counting means for comparing the output of said pixel counting means to said stored pixel count values and generating horizontal synchronization and horizontal blanking signals in response to said comparisons;

line counting means connected to receive said horizontal blanking signal for counting signal transitions associated with the conclusion of each horizontal line scan; and second comparing means connected to said second storage means and said line counting means to said stored line count output of said line counting means to said line count values and generating vertical synchronization and vertical blanking signals in response to said comparisons.

2. The video controller according to claim 1, wherein:

said first comparing means includes means for setting said horizontal blanking signal to a first state when said pixel count equals said first stored pixel value and means for setting said horizontal blanking signal to a second state when said pixel count equals said fourth pixel value, and means for setting said horizontal synchronization signal to a first state when said pixel count equals said second stored pixel value and means for setting said horizontal synchronization signal to a second state when said pixel count equals said third pixel value;

said second comparing means is connected to receive a terminal count signal from said external source, said terminal count signal changing from a first state to a second state upon the conclusion of each screen scan operation; and said second comparing means includes means for setting said vertical blanking signal to a first state when said line count equals said first stored line value and means for setting said vertical blanking signal to a second state when said terminal count signal changes to its second state, and means for setting said vertical synchronization signal to a first state when said line count equals said second stored line value and means for setting said vertical synchronization signal to a second state when said line count equals said third line value.

3. The video controller according to claim 2, further comprising:

means connected to receive said horizontal blanking signal for resetting said pixel counting means whenever said horizontal blanking signal is set to its second state; and means for connected to receive said terminal count signal for resetting said line counting means when said terminal count signal changes to its second state.

* * * * *

UNITED STATES PATENT AND TRADEMARK OFFICE

CERTIFICATE OF CORRECTION

PATENT NO. : 5,124,804

DATED : June 23, 1992

INVENTOR(S) : Angel E. Socarras

It is certified that error appears in the above-identified patent and that said Letters Patent is hereby corrected as shown below:

Column 10, line 4, after second occurrence of "means" insert -- for comparing the output of said line counting means --

Column 10, line 5, after the word count delete "output of said line counting means";

Column 10, line 6, delete "to said line count";

Signed and Sealed this

Twenty-fourth Day of August, 1993

Bruce Lehman

*Attest:*

BRUCE LEHMAN

*Attesting Officer*

*Commissioner of Patents and Trademarks*